US010267551B2

(12) United States Patent
Ji et al.

(10) Patent No.: US 10,267,551 B2
(45) Date of Patent: Apr. 23, 2019

(54) ICE MAKER AND REFRIGERATOR COMPRISING SAME

(71) Applicant: DAE CHANG CO., LTD., Jeongeup-si (KR)

(72) Inventors: Jun Dong Ji, Suwon-si (KR); Jung Woo Lee, Seoul (KR); Jong Myung Kim, Gunpo-si (KR)

(73) Assignee: DAE CHANG CO., LTD., Jeongeup-si (KR)

( * ) Notice: Subject to any disclaimer, the term of this patent is extended or adjusted under 35 U.S.C. 154(b) by 186 days.

(21) Appl. No.: 15/516,032

(22) PCT Filed: Dec. 4, 2014

(86) PCT No.: PCT/KR2014/011857

§ 371 (c)(1),
(2) Date: Mar. 31, 2017

(87) PCT Pub. No.: WO2015/194718

PCT Pub. Date: Dec. 23, 2015

(65) Prior Publication Data

US 2018/0216863 A1 Aug. 2, 2018

(30) Foreign Application Priority Data

Jun. 20, 2014 (KR) ..... 10-2014-0075847
Jul. 4, 2014 (KR) ..... 10-2014-0083984
Oct. 15, 2014 (KR) ..... 10-2014-0138809

(51) Int. Cl.
*F25C 5/08* (2006.01)
*F25C 1/24* (2018.01)

(52) U.S. Cl.
CPC ..... *F25C 5/08* (2013.01); *F25C 1/24* (2013.01); *F25C 2400/10* (2013.01); *F25C 2600/04* (2013.01); *F25C 2700/12* (2013.01)

(58) Field of Classification Search
CPC ..... F25C 1/24; F25C 5/08; F25C 2400/10; F25C 2600/04; F25C 2700/12
See application file for complete search history.

(56) References Cited

U.S. PATENT DOCUMENTS

2005/0066670 A1* 3/2005 Chung ..... F25C 1/04 62/137
2011/0048045 A1* 3/2011 An ..... F25C 1/04 62/137

FOREIGN PATENT DOCUMENTS

DE 3109300 A1 * 9/1982
JP 2005-188913 A 7/2005
(Continued)

OTHER PUBLICATIONS

Written Opinion of the International Searching Authority for PCT/KR2014/011857, dated Mar. 24, 2015, and English Translation thereof.

(Continued)

*Primary Examiner* — Marc E Norman

(57) ABSTRACT

An ice maker includes: an ice tray having partitioned spaces for receiving ice-making water; an ejector for separating ice in the ice tray; a detection unit for detecting at least one of a position of the ejector and a temperature of the ice tray; a control box provided to face the ice tray and including a motor operating the ejector and a printed circuit board provided therein; and a surface type heater provided in the ice tray and including a heating element of a metal thin film or a heat wire and an insulating member surrounding the heating element. The surface type heater is adhered to the ice tray by being pressed by an instrument provided in the ice tray or adhered to the ice tray by being bonded thereto.

20 Claims, 23 Drawing Sheets

(56) References Cited

FOREIGN PATENT DOCUMENTS

| | | | |
|---|---|---|---|
| KR | 10-2007-0094587 | A | 9/2007 |
| KR | 10-0805226 | B1 | 2/2008 |
| KR | 10-0814686 | B1 | 3/2008 |
| KR | 10-2010-0116147 | A | 10/2010 |
| KR | 10-2014-0067592 | A | 6/2014 |

OTHER PUBLICATIONS

International Search Report for PCT/KR2014/011857, dated Mar. 24, 2015, and English Translation thereof.
International Preliminary Report for PCT/KR2014/011857, dated Dec. 20, 2016, and English Translation thereof.

* cited by examiner (a)

(b)

(a)

(b)

(a)

(b)

(a)

(b)

ICE MAKER AND REFRIGERATOR COMPRISING SAME

CROSS-REFERENCE TO RELATED APPLICATION

This application is the National Stage of International Application No. PCT/KR2014/011857, filed on Dec. 4, 2014, which claims the benefit of and priority to Korean Patent Application No. 10-2014-0075847, filed on Jun. 20, 2014, Korean Patent Application No. 10-2014-0083984, filed on Jul. 4, 2014, and Korean Patent Application No. 10-2014-0138809, filed on Oct. 15, 2014, the entire contents of which are incorporated herein by reference for any and all purposes.

TECHNICAL FIELD

Exemplary embodiments of the present invention relate to an ice maker, and more particularly, to an ice maker including a surface type heater and a refrigerator including the same.

BACKGROUND ART

Generally, a refrigerator includes a refrigerating chamber for refrigerating and storing food and a freezing chamber for freezing and storing food. At this point, an ice maker for producing ice is installed in the freezing chamber or the refrigerating chamber.

FIG. 1 is a bottom view of the existing ice maker for a refrigerator.

Referring to FIG. 1, an ice maker 10 includes a heater 27 that is on a lower surface of an ice tray 11. When the ice-making is completed, a heater 27 slightly melts ice firmly coupled to an inner side of the ice tray 11, thereby serving to separate ice. The heater 27 mainly uses a U-shaped sheath heater.

Here, since the heater 27 is formed to be line contact in a U-letter shape under the ice tray 11, and therefore an area in which the heater 27 directly contacts the ice tray 11 decreases, such that heat transfer efficiency is degraded. It takes a lot of time and power to melt ice in the ice tray 11 by transferring heat to a portion not directly contacting the heater 27. At this point, since the ice tray 11 is excessively heated by the heater 27, it takes a lot of time to again cool the ice tray 11 to the ice-making temperature in the ice-making cycle after the ice separation, such that the ice-making time may be long.

RELATED ART DOCUMENT

Korean Patent Laid-Open Publication No. 10-2010-0116147 (Oct. 29, 2010)

DISCLOSURE

Technical Problem

An object of the present invention is to provide an ice maker capable of increasing heat transfer efficiency from a heater to an ice tray and a refrigerator including the same.

Another object of the present invention is to provide an ice maker capable of shortening an ice-making time while reducing power consumption required for the whole ice-making process and a refrigerator including the same.

However, technical objects of the present invention are not limited to the above-mentioned objects. Other objects that are not mentioned above could be obviously understood by those skilled in the art from the following description.

Technical Solution

In accordance with one aspect of the present invention, an ice maker, including: an ice tray including a partitioned space in which ice-making water is received; an ejector separating ice in the ice tray; a detection unit detecting at least one of a position of the ejector and a temperature of the ice tray; a control box provided to face the ice tray and including a motor for driving the ejector and a printed circuit board disposed therein; and a surface type heater provided in the ice tray and including a heating element of a metal thin film or a heat wire and an insulating member surrounding the heating element, with the surface type heater being adhered to the ice tray by being pressed by an instrument provided in the ice tray or adhered to the ice tray by being bonded thereto.

In accordance with another aspect of the present invention, an ice maker, including: an ice tray including a partitioned space in which ice-making water is received; an ejector separating ice in the ice tray; a detection unit detecting at least one of a position of the ejector and a temperature of the ice tray; a control box provided to face the ice tray and including a motor for driving the ejector and a printed circuit board disposed therein; and a surface type heater provided in the ice tray and including a heating element of a metal thin film or a heat wire, an insulating member surrounding the heating element, and a power connection part electrically connected to the heating element, formed of a substrate, and having an electrode pad provided on one surface of the substrate, in which one end portion of the power connection part protrudes from the ice tray to the control box and the surface type heater is pressed by an instrument provided in the ice tray to be adhered to the ice tray or is bonded to the ice tray to be adhered thereto.

In accordance with another aspect of the present invention, an ice maker, including: an ice tray including a partitioned space in which ice-making water is received; an ejector separating ice in the ice tray; a detection unit detecting at least one of a position of the ejector and a temperature of the ice tray; a control box provided to face the ice tray and including a motor for driving the ejector and a printed circuit board disposed therein; a surface type heater provided along a longitudinal direction of the ice tray from one side and the other side of an outer circumferential surface of the ice tray and including a surface type heater first part and a surface type heater second part including a heating element of a metal thin film or a heat wire and an insulating member surrounding the heating element; a cold air contact section exposed from the circumferential surface of the ice tray to an outside between the surface type heater first part and the surface type heater second part; and a power connection part electrically connected to the heating elements of the surface type heater first part and the surface type heater second part, respectively, in which one end of the surface type heater first part and one end of the surface type heater second part are connected to the power connection part and the other end of the surface type heater first part and the other end of the surface type heater second part are connected to or separated from each other, and the surface type heater is pressed by an instrument provided in the ice tray to be adhered to the ice tray or is bonded to the ice tray to be adhered thereto.

In accordance with another aspect of the present invention, an ice maker, including: an ice tray including a partitioned space in which ice-making water is received; an ejector separating ice in the ice tray; a detection unit detecting at least one of a position of the ejector and a temperature of the ice tray; a control box provided to face the ice tray and including a motor for driving the ejector and a printed circuit board disposed therein; a surface type heater provided along a longitudinal direction of the ice tray from one side and the other side of an outer circumferential surface of the ice tray and including a surface type heater first part and a surface type heater second part including a heating element of a metal thin film or a heat wire and an insulating member surrounding the heating element; a cold air contact section exposed from the circumferential surface of the ice tray to an outside between the surface type heater first part and the surface type heater second part; and a power connection part electrically connected to the heating elements of the surface type heater first part and the surface type heater second part, respectively, with the power connection part being provided on one side or the other side of the outer circumferential surface of the ice tray, in which the printed circuit board of the control box is disposed at a side corresponding to the power connection part so that the power connection part is inserted into the control box, and the surface type heater is pressed by an instrument provided in the ice tray to be adhered to the ice tray or is bonded to the ice tray to be adhered thereto.

In accordance with another aspect of the present invention, an ice maker, including: an ice tray including a partitioned space in which ice-making water is received; an ejector separating ice in the ice tray; a detection unit detecting at least one of a position of the ejector and a temperature of the ice tray; a control box provided to face the ice tray and including a motor for driving the ejector and a printed circuit board disposed therein; and a surface type heater provided in the ice tray and including a heating element of a metal thin film or a heat wire and an insulating member surrounding the heating element, in which the surface type heater is primarily adhered to the ice tray by bonding one surface of the surface type heater to the ice tray and secondarily adhered to the ice tray by pressing the other surface of the surface type heater by an instrument provided in the ice tray.

In accordance with another aspect of the present invention, an ice maker, including: an ice tray including a partitioned space in which ice-making water is received; an ejector separating ice in the ice tray; a detection unit detecting at least one of a position of the ejector and a temperature of the ice tray; a control box provided to face the ice tray and including a motor for driving the ejector and a printed circuit board disposed therein; a surface type heater provided in the ice tray and including a heating element of a metal thin film or a heat wire and an insulating member surrounding the heating element; and an adhesive member provided between the surface type heater and the ice tray to adhere the surface type heater to the ice tray.

One surface of the surface type heater may be provided to face the ice tray and the ice maker may include a heater pressing part that is provided in the ice tray and presses the other surface of the surface type heater to adhere the surface type heater to the ice tray.

The heater pressing part may have one side rotatably hinged to the ice tray and press the surface type heater while rotating toward the surface type heater.

The heater pressing part may have at least one of heat insulating property, insulating property, cushion property, heat conduction property, and elastic property.

The ice maker may further include: a heater receiving part provided on an outer circumferential surface of the ice tray and having the surface type heater received therein, in which a surface contacting one surface of the surface type heater of the heater receiving part is formed in a plane.

The surface contacting one surface of the surface type heater of the heater receiving part may be provided to be inclined.

The ice maker may further include: a heater receiving part provided on an outer circumferential surface of the ice tray and having the surface type heater received therein, in which the heater pressing part of which both sides are fixed to the heater receiving part presses the surface type heater.

The heater pressing part may be provided to apply an elastic force to the surface type heater in the heater receiving part.

The surface type heater may be provided along a longitudinal direction of the ice tray and the heater pressing part may be provided to have an area corresponding to the surface type heater to press the other surface of the surface type heater.

The heater pressing part may extend from a guide part provided at one side portion of the ice tray toward the ice tray to press the surface type heater.

The heater pressing part may extend from a heater cover provided under the ice tray toward the ice tray to press the surface type heater.

The ice maker may further include: a cold air flow passage provided between the heater cover and the ice tray.

The ice maker may further include: a heater cover provided between the first surface type heater and the second surface type heater under the ice tray, in which the surface type heater includes a first surface type heater that is provided on one side of the outer circumferential surface of the ice tray and a second surface type heater that is provided on the other side of the outer circumferential surface of the ice tray and the heater pressing part extends from each of both ends of the heater cover toward an outer side to press the first surface type heater and the second surface type heater.

The ice maker may further include: a heater cover including a base plate provided under the ice tray, a first side plate extending from one side of the base plate toward one side of the outer circumferential surface of the ice tray, and a second side plate extending from the other side of the base plate toward the other side of the outer circumferential surface of the ice tray, in which the heater pressing part protrudes the base plate toward the ice tray to press the other surface of the surface type heater.

The ice maker may further include: a heater receiving part provided on an outer circumferential surface of the ice tray and having the surface type heater received therein, in which the heater pressing part presses the other surface of the surface type heater while being fitted in an inner side of the heater receiving part.

The heater pressing part may include at least one pressing protrusion that protrudes toward the surface type heater to press the other surface of the surface type heater.

The ice maker may further include: a heat resistance member or an elastic member provided between the surface type heater and the heater pressing part.

The ice maker may further include: a heater receiving part provided in the ice tray and having the surface type hater received therein; and any one of a heat insulating member, an insulating member, a cushion member, a heat resistance member, and a heat conduction member that is provided on the other surface of the surface type heater in the heater receiving part, in which one surface of the surface type heater is provided to face the ice tray.

The surface type heater may be bonded to the ice tray by a polyimide adhesive, a silicon adhesive, or an adhesive paste including thermally conductive powder.

The power connection part may be formed of any one of a printed circuit board (PCB), a metal PCB, and plastic.

The power connection part electrically connected to the heating element of the surface type heater may include a power interruption unit interrupting power applied to the heating element when the temperature of the surface type heater exceeds a preset temperature or a current exceeding a preset current flows.

The surface type heater may further includes: a 1-1-th electrode pad provided in the power connection part, electrically connected to one end of the heating element, and connected to the connector; and a 1-2-th electrode pad provided on the power connection part, electrically connected to the other end of the heating element, and connected to the connector, and the 1-1-th electrode pad or the 1-2-th electrode pad may be provided so that a portion electrically connected to the heating element and a portion connected to the connector are spaced apart from each other and the power interruption unit may be provided to electrically connect between the portions spaced apart from the 1-1-th electrode pad or the 1-2-th electrode pad.

The power interruption unit may be a thermal fuse or a bimetal.

The power connection part electrically connected to the heating element of the surface type heater may further include: a temperature sensor measuring a temperature of at least one of the ice tray and the surface type heater; and a second electrode pad electrically connected to the temperature sensor.

The surface type heater may include a support plate that is provided at a length corresponding to the surface type heater and is formed of any one of a PCB, a metal PCB, and plastic, and the heating element may be provided by adhering a metal thin film or a heat wire to one surface of the support plate.

The surface type heater may be formed in a thin type and the heating element may be formed of a metal thin film having a thickness greater than 0 and less than or equal to 0.5 mm.

The ice maker may further include a control unit provided in the control box, in which the control unit controls an operation of the surface type heater depending on at least one of a rotational position of the ejector, an operation time of the ejector, and a temperature of the ice tray.

An outer cover of the surface type heater may be cross-linked by electron beam irradiation.

An outer side of the surface type heater may be provided with a shrink tube to surround the surface type heater.

The surface type heater may be screw-coupled to the ice tray by a coupling member that penetrates through the surface type heater.

The ice maker may further include: a mounting guide part provided on the outer circumferential surface of the ice tray and fixedly mounted with the power connection part of the surface type heater.

One side of the heating element and the insulating member on the lower surface of the power connection part of the surface type heater may be adhered to the ice tray and one end of the heating element may be electrically connected to the electrode pad formed on the upper surface of the power connection part through an insertion hole formed in the power connection part.

The surface type heater may have a heating density changed depending on a position corresponding to the ice tray.

The surface type heater may be provided so that a portion corresponding to at least one of one end of the ice tray, the other end of the ice tray, and a central portion of the ice tray has the heating density higher than that of other portions.

The surface type heater may have a heating density changed depending on a position corresponding to the ice tray.

The surface type heater may be provided on the outer circumferential surface of the ice tray in a closed loop form or an open loop form in which a portion of the surface type heater is open.

The surface type heater may be provided on the outer circumferential surface of the ice tray to be biased to one side with respect to a center of the ice tray.

The printed circuit board of the control box may be provided to be biased to one side corresponding to the surface type heater with respect to the center of the control box.

The surface type heater may be provided on the outer circumferential surface of the ice tray to be biased to a partition wall provided in the ice tray with respect to a center of the ice tray.

The power connection part of the surface type heater may be provided to be further biased to one side than a body of the surface type heater that is provided on the outer circumferential surface of the ice tray.

The ice maker may further include: a power interruption unit provided on an end surface portion of the ice tray and electrically connected to the power connection part; and a temperature sensor provided on the end surface portion of the ice tray to be adjacent to the power interruption unit and electrically connected to the power connection part.

The surface type heater may be supplied with DC power.

Advantageous Effects

According to the embodiment of the present invention, the surface type heater is provided to be in surface contact with the outer circumferential surface of the ice tray, and therefore may increase the contact area with the ice tray, thereby increasing the heat transfer efficiency from the surface type heater to the ice tray and melting the ice frozen on the inner side of the ice tray even with the small quantity of heat and the short operation time. Further, the insulating member is provided on the other surface of the surface type heater, thereby preventing the heat from being leaked to the outside of the ice tray.

Further, it is possible to improve the heat efficiency transmitted from the surface type heater to the ice tray by adhering the surface type heater to the ice tray through the adhesive member or the heater pressing part.

Further, it is possible to raise the surface type heater to the preset temperature in a short time and to reduce the power consumption used for the surface type heater by making the surface type heater thin to make the heat capacity of the surface type heater small.

Further, it is possible to decrease the power consumption required to melt the ice frozen on the inner circumferential surface of the ice tray by controlling the operations of the first surface type heater and the second surface type heater according to the rotational position of the ejector or the passage of the operation time of the ejector.

Further, it is possible to form the power interruption unit, the temperature sensor, or the like in the power connection part with the simple structure and circuit by providing the surface type heater in the modular form, including the power connection part formed of the PCB, the metal PCB, or the like.

Further, it is possible to simplify the power connection structure of the surface type heater and easily connect (i.e., implement one touch connection) or detach the power connection part of the surface type heater to the connector by connecting the power connection part of the surface type heater to the connector provided in the control box.

In addition, it is possible to simplify the structure of the printed circuit board in the control box and electrically connect the power interruption unit, the temperature sensor, or the like to the surface type heater and mount the power interruption unit, the temperature sensor, or the like on the ice tray while being adjacent to each other by biasing the surface type heater to one side with respect to the center of the ice tray.

BEST MODE

Hereinafter, an ice maker and a refrigerator including the same according to an embodiment of the present invention will be described with reference to FIGS. 2 to 30. However, the exemplary embodiments are described by way of examples only and the present invention is not limited thereto.

In describing the present invention, when a detailed description of well-known technology relating to the present invention may unnecessarily make unclear the spirit of the present invention, a detailed description thereof will be omitted. Further, the following terminologies are defined in consideration of the functions in the present invention and may be construed in different ways by the intention of users and operators. Therefore, the definitions thereof should be construed based on the contents throughout the specification.

As a result, the spirit of the present invention is determined by the claims and the following exemplary embodiments may be provided to efficiently describe the spirit of the present invention to those skilled in the art.

Figure 1:
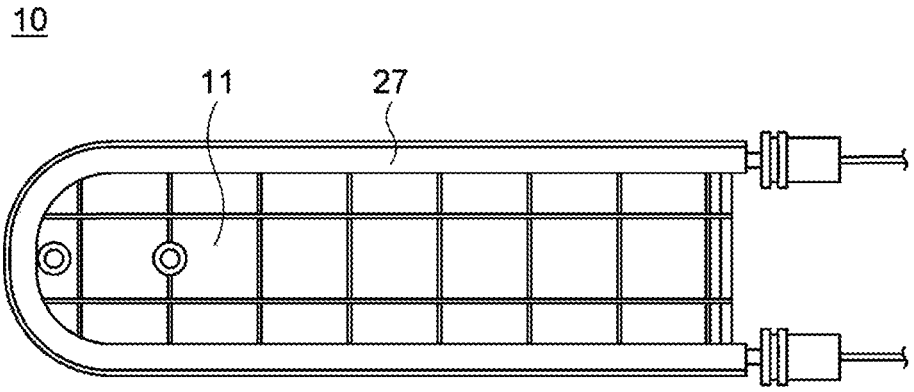
FIG. 1 is a bottom view of the existing ice maker for a refrigerator.
Figure 2:
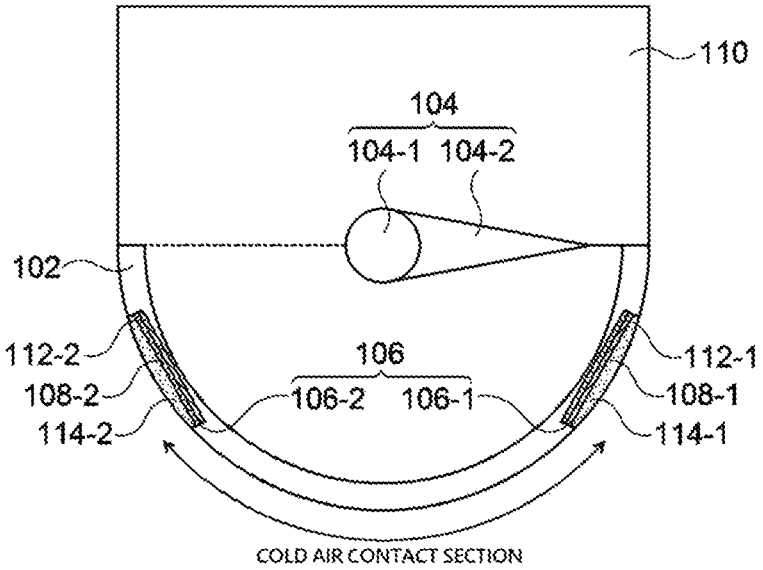
FIG. 2 is a cross-sectional view of an ice maker according to an embodiment of the present invention.
Figure 3:
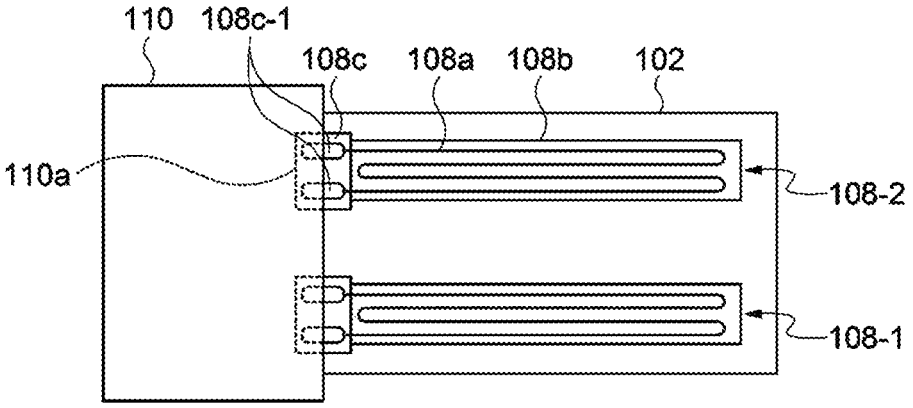
FIG. 3 is a bottom view of the ice maker according to the embodiment of the present invention.

FIG. 2 is a cross-sectional view of an ice maker according to an embodiment of the present invention and FIG. 3 is a bottom view of the ice maker according to the embodiment of the present invention.

Referring to FIGS. 2 and 3, an ice maker 100 includes an ice tray 102, an ejector 104, a heater receiving part 106, a surface type heater 108, and a control box 110.

The ice tray 102 has an ice-making space for containing water provided therein. The inside of the ice tray 102 may be provided with a plurality of partition walls to partition the ice-making space into a plurality of spaces. At this point, the respective separated ice-making spaces in the ice tray 102 may be formed to correspond to ejector pins 104-2. An inner circumferential surface of the ice tray 102 may be provided in a semicircular arc shape having a radius corresponding to a length of the ejector pin 104-2 so that the ejector pin 104-2 may rotate to separate ice.

The ejector 104 serves to separate the ice in the ice tray 102. The ejector 104 includes an ejector shaft 104-1 connected to a motor (not illustrated) in the control box 108 and a plurality of ejector pins 104-2 formed on the ejector shaft 104-1 while being spaced apart from each other. The ejector pin 104-2 rotates in a predetermined direction (for example, clockwise direction in FIG. 2) with respect to the ejector shaft 104-1 to separate the ice in the ice tray 102.

The heater receiving part 106 may be provided on an outer circumferential surface of the ice tray 102. The heater receiving part 106 is a part where the surface type heater 108 is mounted. The heater receiving part 106 may be provided on the outer circumferential surface of the ice tray 102 in a form of a receiving groove. At this point, a surface (i.e., bottom surface of the receiving groove) on which the surface type heater 108 is mounted on the heater receiving part 106 may be provided in a plane.

That is, the outer circumferential surface of the ice tray 102 is formed in a curved line having a shape corresponding to the inner circumferential surface of the ice tray 102. By the way, if the surface type heater 108 is mounted on the curved surface, a heating element of the surface type heater 108 may be damage, and therefore the surface on which the surface type heater 108 is mounted on the heater receiving part 106 is formed in the plane, such that the heating element of the surface type heater 108 may be prevented from being damaged.

The heater receiving part 106 may include a first heater receiving part 106-1 that is provided on one side of the outer circumferential surface of the ice tray 102 and a second heater receiving part 106-2 that is provided on the other side of the outer circumferential surface of the ice tray 102. Here, one side of the outer circumferential surface of the ice tray 102 refers to a side corresponding to a home position (i.e., starting position) of the ejector pin 104-2 and the other side of the outer circumferential surface of the ice tray 102 refers to a side positioned in a direction opposite to the one side.

The surface type heater 108 may be provided in the heater receiving part 106. At this point, the surface type heater 108 is provided to be in surface contact with the outer circumferential surface of the ice tray 102. The surface type heater 108 may be provided along a longitudinal direction of the ice tray 102. The surface type heater 108 may generate heat over a predetermined area. The surface type heater 108 may be made thin.

For example, a thickness of the surface type heater 108 may be greater than 0 and less than or equal to 1 mm. The lower limit of the thickness of the surface type heater 108 may be set appropriately by those skilled in the art depending on a material of a heating element and an insulating member constituting the surface type heater 108. By making the surface type heater 108 thin to make a heat capacity of the surface type heater 108 small, the surface type heater 108 may rise to a preset temperature in a short time. By doing so, it is possible to decrease power consumption used for the surface type heater 108. As the surface type heater 108, for example, a positive temperature coefficient (PTC) heater may be used, but the present invention is not limited thereto.

The surface type heater 108 may include a heating element 108*a*, an insulating member 108*b*, and a power connection part 108*c*. The heating element 108*a* may be provided over the entire area of the surface type heater 108 to generate heat. For example, the heating element 108*a* may be provided over the entire area of the surface type heater 108 in a form of a zigzag. As the heating element 108*a*, for example, metal thin films or heat wires such as a stainless steel thin film or a heat wire, a platinum thin film or a heat wire, a tungsten thin film or a heat wire, and a nickel thin film or a heat wire may be used. However, the present invention is not limited thereto, and therefore the heating element 108*a* may be formed by thinly coating a carbon nano tube, a carbon nano plate, or the like. The thickness of the heating element 108*a* may be greater than 0 and less than or equal to 0.5 mm. The lower limit of the thickness of the heating element 108*a* may be set appropriately by those skilled in the art depending on the material of the heating element.

The insulating member 108*b* may be provided to surround the heating element 108*a*. The insulating member 108*b* may be made of materials such as polyimide and graphene. In this case, the heating element 108*a* may be stably protected even if the heating element 108*a* rises to a high temperature or an external impact is applied. However, the present invention is not limited thereto, and the insulating member 108*b* may be made of various other insulating materials. The insulating member 108*b* may be formed in the film form. The insulating member 108*b* may include a first insulating member provided on one surface of the heating member 108*a* to surround the heating member 108*a* and a second insulating member provided on the other surface of the heating element 108*a* to surround the heating member 108*a*.

The power connection part 108*c* may be provided at an end of the surface type heater 108. The power connection part 108*c* may be formed of a printed circuit board (PCB) or a metal PCB. The power connection part 108*c* may be provided with an electrode pad 108*c*-1 to which both ends of the heating element 108*a* are electrically connected. An insulating member (not illustrated) may be formed on a portion of the electrode pad 108*c*-1 to which the heating element 108*a* is connected in the power connection part 108*c* to surround the electrode pad 108*c*-1. The power connection part 108*c* may be connected to a connector 110*a* that is provided in the control box 110. At this point, the electrode pad 108*c*-1 of the power connection part 108*c* may be electrically connected to the connector 110*a*. The power connection part 108*c* is electrically connected to a power supply unit (not illustrated) through the connector 110*a* and serves to apply power from the power supply unit (not illustrated) to the heating element 108*a*. The power supply unit (not illustrated) may be provided in the control box 110 but the present invention is not limited thereto, and therefore the power supply unit may also be provided in other units (for example, refrigerator control unit) of the refrigerator on which the ice maker 100 is mounted.

The surface type heater 108 may be bonded to the ice tray 120 in the heater receiving part 106 to be adhered thereto. The surface type heater 108 includes a first surface type heater 108-1 that is received in the first heater receiving part 106-1 and a second surface type heater 108-2 that is received in the second heater receiving part 106-2. One surface (i.e., surface facing the ice tray 102) of the first surface type heater 108-1 may be provided with a first adhesive member 112-1. The first surface type heater 108-1 may be adhered to the outer circumferential surface of the ice tray 102 through the first adhesive member 112-1. One surface (i.e., surface facing the ice tray 102) of the second surface type heater 108-2 may be provided with a second adhesive member 112-2. The second surface type heater 108-2 may be adhered to the outer circumferential surface of the ice tray 102 through the second adhesive member 112-2.

As the first adhesive member 112-1 and the second adhesive member 112-2, for example, a polyimide adhesive may be used. However, the present invention is not limited thereto, and as the first adhesive member 112-1 and the second adhesive member 112-2, an adhesive paste including thermally conductive powder may be used. In this case, the first surface type heater 108-1 and the second surface type heater 108-2 may not only be bonded to the ice tray 102, but the heat generated from the first surface type heater 108-1 and the second surface type heater 108-2 may also be transferred to the ice tray 102 effectively.

The other surface of the first surface type heater 108-1 and the other surface of the second surface type heater 108-2 may each be provided with a first heat insulating member 114-1 and a second heat insulating member 114-2. The first heat insulating member 114-1 and the second heat insulating member 114-2 each serve to prevent the heat generated from the first and second surface type heaters 108-1 and 108-2 from being leaked to the outside of the ice tray 102. In this case, it is possible to increase the heat transfer efficiency of transferring the heat generated from the first and second surface type heaters 108-1 and 108-2 to the inner side of the ice tray 102. The surfaces of the first heat insulating member 114-1 and the heat second insulating member 114-2 may form the outer circumferential surface of the ice tray 102.

Here, the first surface type heater 108-1 and the second surface type heater 108-2 are provided to be in surface contact with the ice tray 102, and therefore the contact area with the ice tray 102 may be increased. In this case, the heat transfer efficiency from the first surface type heater 108-1 and the second surface type heater 108-2 to the ice tray 102 may be increased, and thus the ice frozen on the inner side of the ice tray 102 may be melted even with a small quantity of heat and a short operation time.

Further, the first surface type heater 108-1 and the second surface type heater 108-2 are provided on both sides of the outer circumferential surface of the ice tray 102 and the first heat insulating member 114-1 and the second heat insulating member 114-2 are provided on the other surface of the first surface type heater 108-1 and the other surface of the second surface type heater 114-2, such that hot air may be quickly transferred to the entire region in the ice tray 102 through the first surface type heater 108-1 and the second surface type heater 108-2.

Meanwhile, a bottom surface of the outer circumferential surface of the ice tray 102 is provided with a cold air contact section. That is, a region between the first surface type heater 108-1 and the second surface type heater 108-2 of the outer circumferential surface of the ice tray 102 may be exposed to the outside. The cold air contact section is a region in which the ice tray 102 is in contact with cold air in an ice-making chamber and serves to allow the temperature of the ice tray 102 to reach the ice-making temperature in a short time.

That is, if the first surface type heater 108-1 and the second surface type heater 108-2 heat the ice tray 102 to slightly melt the ice frozen on the inner circumferential surface of the ice tray 102, the ejector 104 rotates to transfer ice to an ice bank (not illustrated). Thereafter, ice-making water is supplied into the ice tray 102 to perform an ice-making process again. At this point, the temperature of the ice tray 102 may reach the ice-making temperature in a short time by securing the region where the ice tray 102 is in contact with the cold air in the ice-making chamber through the cold air contact section, thereby shortening the overall ice-making time.

The control box 110 may be provided on one side of the ice tray 102. The control box 110 may be coupled with the ice tray 102 on one side of the ice tray 102. The control box 110 may be provided with a control unit (not illustrated) for controlling the overall operation of the ice maker 100. In addition, the control box 110 may be provided with an ice-separating motor (not illustrated) for rotating the ejector 104 in a predetermined direction. The control box 110 may be provided with a power supply unit (not illustrated) for supplying power to the ice-separating motor (not shown) and the surface type heater 108.

Here, the control unit (not illustrated) may control an on or off operation of the first surface type heater 108-1 and the second surface type heater 108-2, for example, according to the rotational position of the ejector 104 or the passage of the operation time of the ejector 104. Specifically, if a temperature of the ice tray 102 reaches a predetermined ice-making temperature (i.e., temperature at which the ice-making water in the ice tray 102 is fully frozen), the control unit (not illustrated) may operate the first and second surface type heaters 108-1 and 108-2.

Next, the control unit (not illustrated) rotates the ejector 104 clockwise as in FIG. 2 and starts to separate the ice in the ice tray 102. The control unit (not illustrated) may turn off the first surface type heater 108-1 when the position of the ejector 104 passes the first surface type heater 108-1 (i.e., when the ejector 104 enters the cold air contact section). In this case, it is possible to decrease power consumption required to melt ice. At this point, the control unit (not illustrated) confirms the home position of the ejector 104 using a position sensor (not illustrated) and then cumulatively calculates the number of pulse signals input from the ice-separating motor (not illustrated) to confirm the current position (i.e., the rotational position of the ejector pin 104-2) of the ejector 104.

Here, it is described that the control unit (not illustrated) turns on both the first surface type heater 108-1 and the second surface type heater 108-2 and then turns off the first surface type heater 108-1 when the ejector 104 passes through the first surface type heater 108-1, but the present invention is not limited thereto. Therefore, the operations of the first surface type heater 108-1 and the second surface type heater 108-2 may be controlled by various other ways.

For example, when the temperature of the ice tray 102 reaches the preset ice-making temperature, the control unit (not illustrated) operates only the first surface type heater 108-1 and may turn on the second surface type heater 108-2 while turning off the first surface type heater 108-1 when the ejector 104 passes through the first surface type heater 108-1. Alternatively, when the ejector 104 passes through the first surface type heater 108-1, the control unit may turn off the first surface type heater 108-1 and turn on the second surface type heater 108-2 before the ejector 104 passes through the second surface type heater 108-2 (i.e., while the ejector 104 is positioned in the cold air contact section).

Further, it is described that the control unit (not illustrated) controls the first surface type heater 108-1 and the second surface type heater 108-2 according to the position of the ejector 104 but the present invention is not limited thereto, and therefore the control unit (not illustrated) may also control the first and second surface type heaters 108-1 and 108-2 according to the passage of time after rotating the ejector 104.

Meanwhile, it is described that the adhesive member 112 is provided on one surface of the surface type heater 108 and the heat insulating member 114 is provided on the other surface of the surface type heater 108 but the present invention is not limited thereto, and therefore an insulating film may be adheredly fixed to the other surface of the surface type heater 108. Further, an adhering member having at least one of a cushion function, a heat conduction function, a heat resistance function, and an insulation function may be fixedly provided on the other surface of the surface type heater 108.

According to the embodiment of the present invention, the surface type heater 108 is provided to be in surface contact with the outer circumferential surface of the ice tray, and therefore may increase the contact area with the ice tray, thereby increasing the heat transfer efficiency from the surface type heater 108 to the ice tray 102 and melting the ice frozen on the inner side of the ice tray 102 even with the small quantity of heat and the short operation time. Further, it is possible to prevent a heat loss from being leaked to the outside of the ice tray 102 by providing the heat insulating member 114 on the other surface of the surface type heater 108. Further, it is possible to raise the surface type heater 108 to the predetermined temperature in a short time and decrease the power consumption used for the surface type heater 108 by making the surface type heater 108 thin to make the heat capacity of the surface type heater 108 small. Further, it is possible to decrease the power consumption required to melt the ice frozen on the inner circumferential surface of the ice tray by controlling the operations of the first surface type heater 108-1 and the second surface type heater 108-2 according to the rotational position of the ejector or the passage of the operation time of the ejector.

Figure 4:
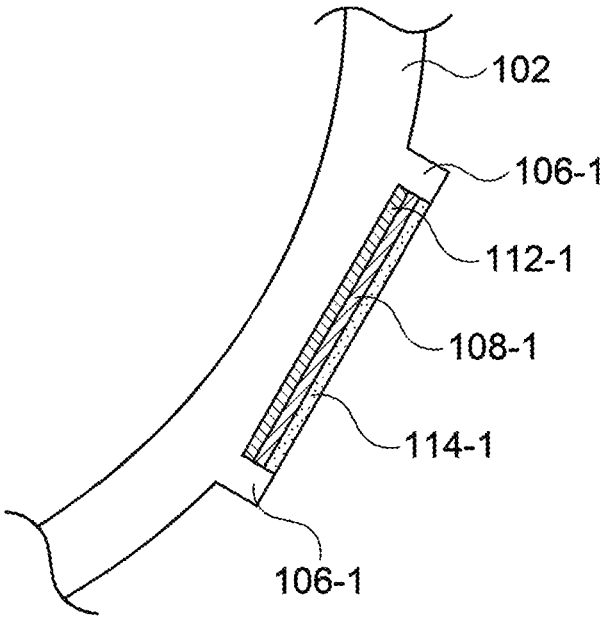
FIG. 4 is a view illustrating another embodiment of a heater receiving part in the ice maker according to the embodiment of the present invention.

FIG. 4 is a view illustrating another embodiment of a heater receiving part in the ice maker according to the embodiment of the present invention. Here, the first heater receiving part 106-1 provided on one side of the outer circumferential surface of the ice tray 102 is illustrated.

Referring to FIG. 4, the first heater receiving part 106-1 may have a receiving protruding part that protrudes from the outer circumferential surface of the ice tray 102. At this point, the first heater receiving part 106-1 may be provided in a size and a shape corresponding to the first surface type heater 108-1 so that both sides of the first surface type heater 108-1 are seated on an inner wall of the first heater receiving part 106-1. The surface on which the first surface type heater 108-1 is mounted on the outer circumferential surface of the ice tray 102 may be formed in a plane. At this point, the surface on which the first surface type heater 108-1 is mounted may be inclinedly provided. In this case, it is possible to prevent the heating element of the first surface type heater 108-1 from being damaged while maintaining the original shape of the ice tray 102 to the maximum extent possible. One surface of the first surface type heater 108-1 may be provided with a first adhesive member 112-1 to be adhered to the ice tray 102. The other surface of the first surface type heater 108-1 may be provided with the first heat insulating member 114-1. The first heater receiving part 106-1 may fix the position of the first surface type heater 108-1 while preventing the first adhesive member 112-1 from being leaked.

Figure 5:
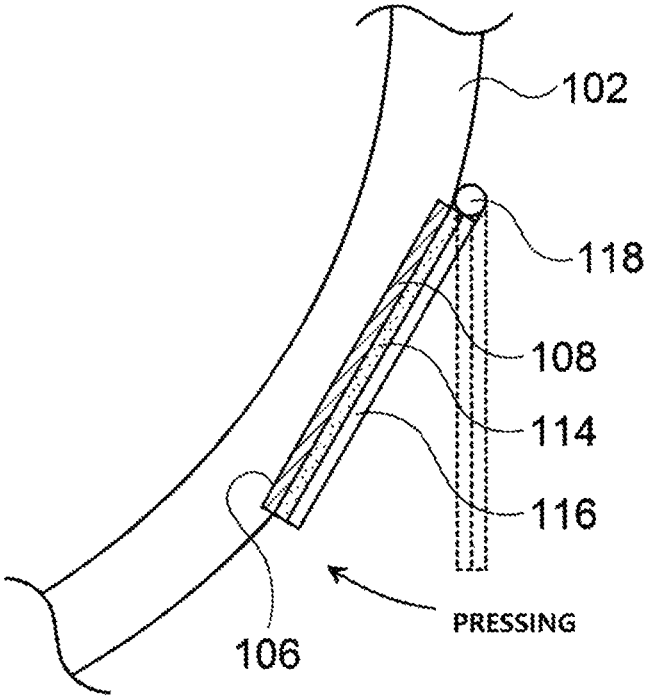
FIG. 5 is a cross-sectional view of an ice maker according to another embodiment of the present invention.

FIG. 5 is a cross-sectional view of an ice maker according to another embodiment of the present invention.

Referring to FIG. 5, the ice maker 100 may further include a heater pressing part 116 and an elastic member 118.

The outer circumferential surface of the ice tray 102 may be provided with the heater receiving part 106. The heater receiving part 106 may be provided on the outer circumferential surface of the ice tray 102 in the form of the receiving groove. At this point, a surface (i.e., bottom surface of the receiving groove) on which the surface type heater 108 is mounted on the heater receiving part 106 may be provided in a plane. Here, it is illustrated that the heater receiving part 106 has the form of the receiving groove receiving the surface type heater 108 but the present invention is not limited thereto, and therefore the heater receiving part 106 may be formed in the form of the receiving protruding part that protrudes from the outer circumferential surface of the ice tray 102.

The heater pressing part 116 serves to press the surface type heater 108 from the other side of the surface type heater 108 to allow the surface type heater 108 to be adhered to the ice tray 102. The heater pressing part 116 may be provided in a shape corresponding to the entire area of the surface type heater 108 to press the entire area of the surface type heater 108. That is, the surface type heater 108 may be provided along a longitudinal direction of the surface type heater 108 in the ice tray 102. One surface (i.e., surface facing the surface type heater 108) of the heater pressing part 116 may be provided with the heat insulating member 114.

The elastic member 118 may be fixedly provided to an upper side of the heater receiving part 106 in the ice tray 102. The heater pressing part 116 may be rotatably coupled to the elastic member 118. The elastic member 118 serves to provide an elastic force to allow the heater pressing part 116 to press the surface type heater 108. That is, the elastic member 118 provides the elastic force to the heater pressing part 116 in the ice tray 102.

The surface type heater 108 is positioned on the heater receiving part 106 in the state in which the heater pressing part 116 is held and rotates in an outer direction (counterclockwise in FIG. 5) of the ice tray 102. At this point, the elastic member 118 provides an elastic force in an inner direction (clockwise in FIG. 5) of the ice tray 102. Therefore, if the heater pressing part 116 is placed, the heater pressing part 116 presses the other surface of the surface type heater 108 while rotating to the inner side of the ice tray 102. In this case, the surface type heater 108 may be adhered to the ice tray 102 without the separate adhesive member, thereby improving the heat conduction efficiency.

Meanwhile, it is illustrated that the elastic member 118 is provided on the upper side of the heater receiving part 106 but the present invention is not limited thereto, and therefore the elastic member 118 may also be provided at the lower side of the heater receiving part 106.

Figure 6:
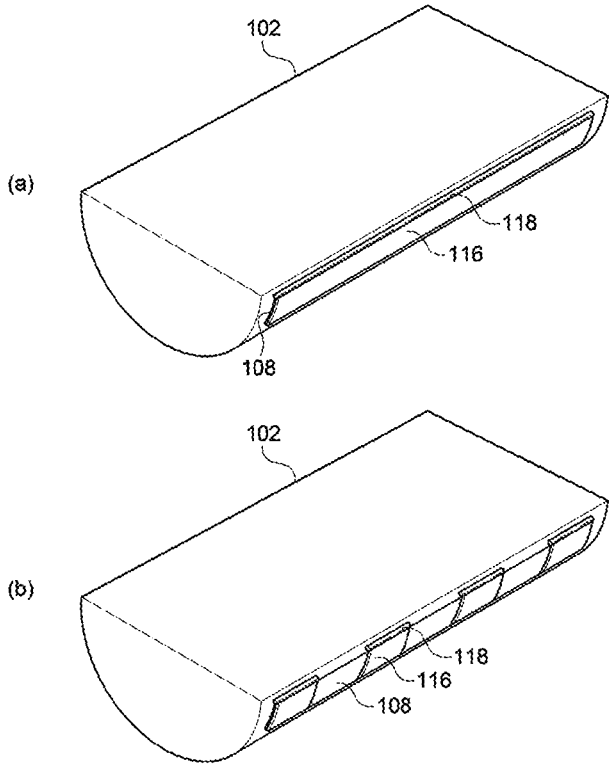
FIG. 6 is a view illustrating embodiments in which a heater pressing part is formed in an ice tray, in the ice maker according to another embodiment of the present invention.

FIG. 6 is a view illustrating embodiments in which a heater pressing part is formed in an ice tray, in the ice maker according to another embodiment of the present invention.

Referring to FIG. 6A, the surface type heater 108 may be provided along the longitudinal direction of the ice tray 102 on the outer circumferential surface of the ice tray 102. The elastic member 118 may be provided along the longitudinal direction of the surface type heater 108 on the upper side of the surface type heater 108. The heater pressing part 116 may be rotatably coupled with the elastic member 118 and may be provided to correspond to the entire area of the surface type heater 108 to press the entire area of the surface type heater 108.

Referring to FIG. 6B, the surface type heater 108 may be provided along the longitudinal direction of the ice tray 102 on the outer circumferential surface of the ice tray 102. The plurality of elastic members 118 may be provided along the longitudinal direction of the surface type heater 108 on the upper side of the surface type heater 108 while being spaced apart from each other. The heater pressing parts 116 may be rotatably coupled to the plurality of elastic members 118, respectively. In this point, the heater pressing part 116 may press the surface type heater 108 in the longitudinal direction of the surface type heater 108 every section having a predetermined length.

Figure 7:
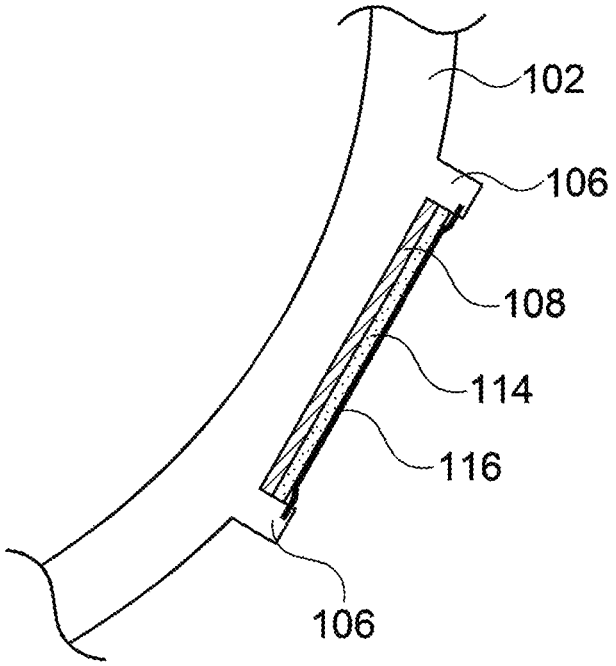
FIG. 7 is a view illustrating another embodiment of the heater receiving part, in the ice maker according to another embodiment of the present invention.

FIG. 7 is a view illustrating another embodiment of the heater receiving part, in the ice maker according to another embodiment of the present invention.

Referring to FIG. 7, the heater receiving part 106 may have the receiving protruding part that protrudes from the outer circumferential surface of the ice tray 102. The heater receiving part 106 may include a pair of receiving protruding parts that protrude from the outer surface of the ice tray 102 while being spaced apart from each other at a predetermined interval (for example, interval corresponding to a width of the surface type heater 108). At this point, the heater receiving part 106 may be provided in the size and shape corresponding to the surface type heater 108 so that both sides of the surface type heater 108 are seated on the inner wall of the heater receiving part 106.

Here, the heater pressing part 116 may be provided to press the other surface of the surface type heater 108 in the state in which both sides of the heater pressing part 116 are each fixed to the heater receiving part 106 protruding from the outer circumferential surface of the ice tray 102. As the heater pressing part 116, for example, a leaf spring may be used. One surface of the heater pressing part 116 or the other surface of the surface type heater 108 may be provided with the heat insulating member 114.

Meanwhile, here, it is illustrated that the heater receiving part 106 is formed in the shape of the receiving protruding part but the present invention is not limited thereto, and therefore the heater receiving part 106 may also be formed in the shape of the receiving groove.

Figure 8:
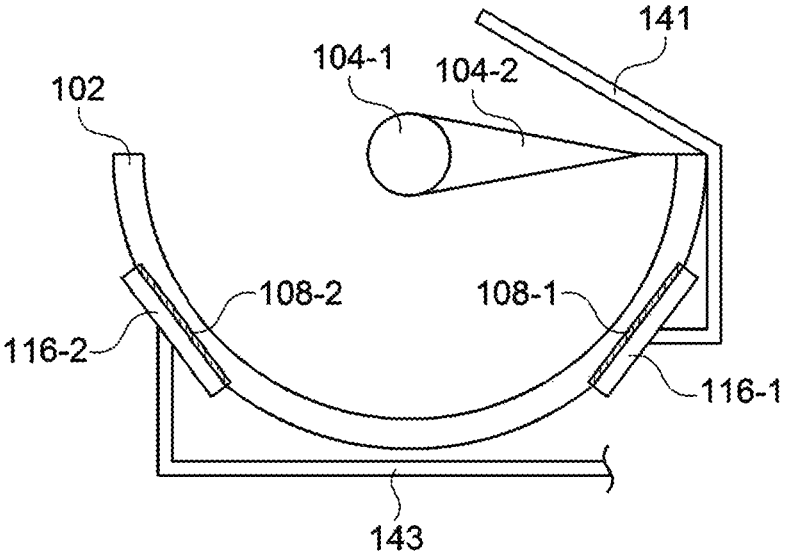
FIG. 8 is a view illustrating another embodiment of the heater receiving part, in the ice maker according to another embodiment of the present invention.

FIG. 8 is a view illustrating another embodiment of the heater pressing part, in the ice maker according to another embodiment of the present invention.

Referring to FIG. 8, the ice maker 100 may further include a guide part 141 provided on one side of the ice tray 102 and a heater cover 143 provided under the ice tray 102. The guide part 141 serves to guide the separated ice to the ice bank (not illustrated) provided under the ice tray 102 when the ejector 104 rotates to separate the ice in the ice tray 102. The guide part 141 may be formed to be inclined downward from the upper portion of the ice tray 102 and may be provided along one side of the ice tray 102. The heater cover 143 may be provided under the ice tray 102 to form a space spaced between the heater cover 143 and the ice tray 102. The cold air may move to the space spaced between the heater cover 143 and the ice tray 102. The heater cover 143 may protect the surface type heater 108 from external environment.

The first heater pressing part 116-1 may be provided by pressing the first surface type heater 108-1 provided on one side of the outer circumferential surface of the ice tray 102. The first heater pressing part 116-1 may extend from the guide part 141 toward the ice tray 102 and may be provided to press the other surface of the first surface type heater 108-1. At this point, the heat insulating member (not illustrated) may be provided between the first surface type heater 108-1 and the first heater pressing part 116-1.

The second heater pressing part 116-2 may be provided by pressing the second surface type heater 108-2 provided on the other side of the outer circumferential surface of the ice tray 102. The second heater pressing part 116-2 may extend from the heater cover 143 toward the ice tray 102 and may be provided to press the second surface type heater 108-2. At this point, the heat insulating member (not illustrated) may be provided between the second surface type heater 108-2 and the second heater pressing part 116-2.

Here, it is described that the first heater pressing part 116-1 extends from the guide part 141 toward the ice tray 102 and the second heater pressing part 116-2 extends from the heater cover 143 toward the ice tray 102 but both of the first heater pressing part 116-1 and the second heater pressing part 116-2 may extend from the heater cover 143 toward the ice tray 102. The heater cover 143 may be provided between the first surface type heater 108-1 and the second surface type heater 108-2 under the ice tray 102. Further, the cold air moves to the space between the heater cover 143 and the ice tray 102. At this point, the first heater pressing part 116-1 and the second heater pressing part 116-2 extend outward from both ends of the heater cover 143, respectively, to press the first surface type heater 108-1 and the second surface type heater 108-2.

Figure 9:
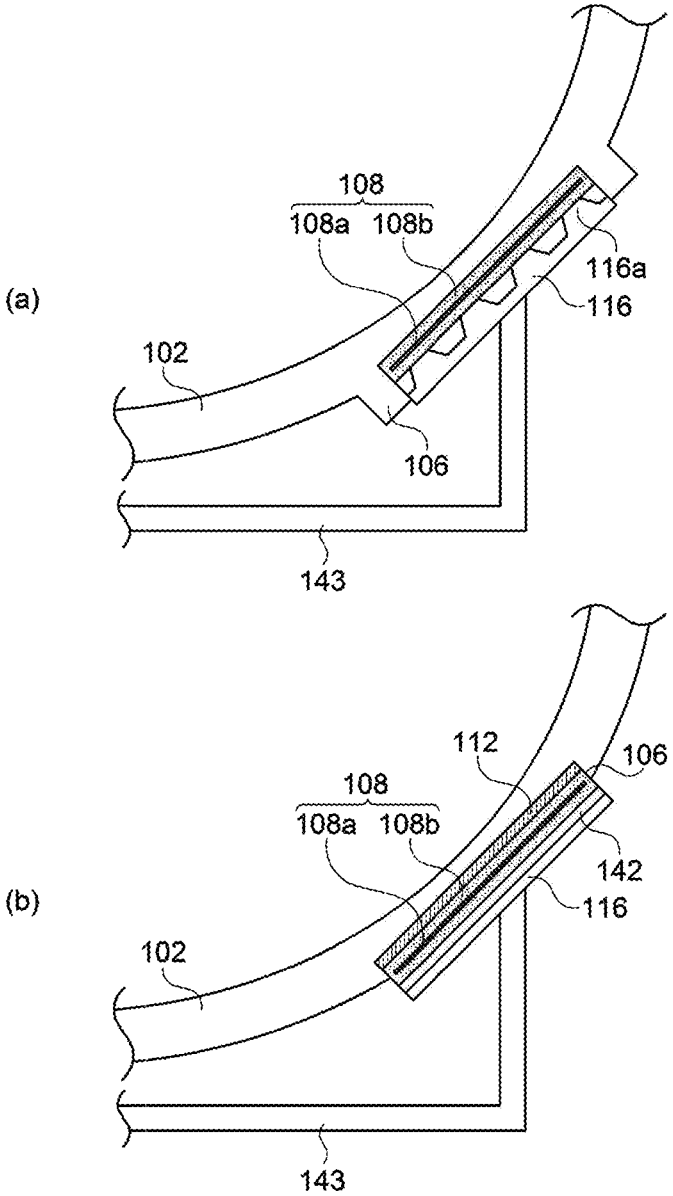
FIG. 9 is a view illustrating another embodiment of the heater pressing part, in the ice maker according to another embodiment of the present invention.

FIG. 9 is a view illustrating another embodiment of the heater pressing part, in the ice maker according to another embodiment of the present invention.

Referring to FIG. 9A, the surface type heater 108 including the heating element **108*a* and the insulating member 108*b* may be received in the heater receiving part 106 that protrudes from the outer circumferential surface of the ice tray 102. One surface of the surface type heater 108 is provided to face the ice tray 102. One side of the surface type heater 108 may be provided to contact the ice tray 102 but the present invention is not limited thereto, and therefore the adhesive member may be provided between the surface type heater 108 and the ice tray 102. The heater pressing part 116 may extend from the heater cover 143 toward the ice tray 102 to press the surface type heater 108**.

The heater pressing part 116 may be fixed while being fitted into the inside of the heater receiving part 106. Further, the heater pressing part 116 may be provided with at least one pressing protrusion **116*a*. The pressing projection 116*a* protrudes from the heater pressing part 116 toward the surface type heater 108 and presses the other surface of the surface type heater 108. The end of the pressing projection 116*a* may be provided to be in surface contact with the other surface of the surface type heater 108. For example, the pressing projections 116*a* may have a trapezoid, a square, or the like. However, the present invention is not limited thereto, and the pressing projections 116*a*** may have various shapes other than a triangle, a semicircle, or the like.

Referring to FIG. 9B, the surface type heater 108 including the heating element **108*a* and the insulating member 108*b* may be received in the heater receiving part 106 that is provided in the receiving groove on the outer circumferential surface of the ice tray 102. The heater pressing part 116 may extend from the heater cover 143 toward the ice tray 102 to press the surface type heater 108. The adhering member 142 may be provided between the surface type heater 108 and the heater pressing part 116. The adhering member 142** may be, for example, the insulating member having a film form or the heat resistance member but the present invention is not limited thereto, and therefore a cushion member (e.g., rubber, silicone, urethane, or the like) may be used.

Figure 10:
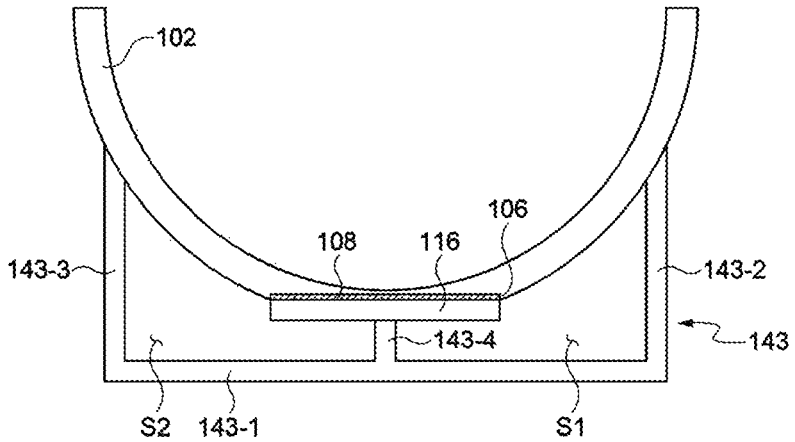
FIG. 10 is a view illustrating a state in which the heater receiving part is provided on a heater cover, in the ice maker according to another embodiment of the present invention.
Figure 10:
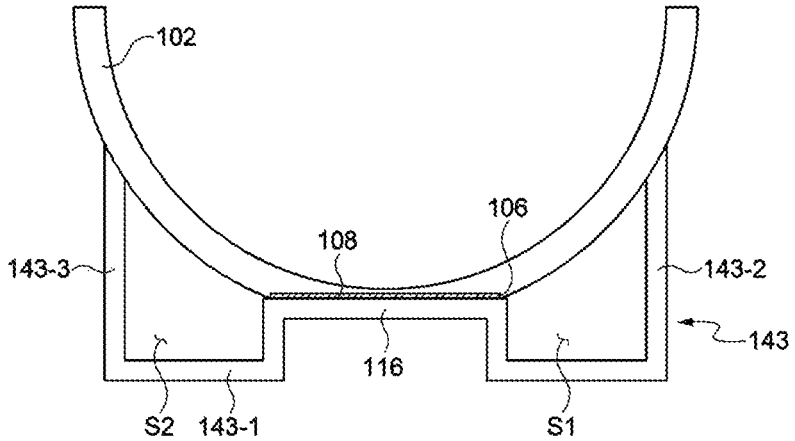

FIG. 10 is a view illustrating the state in which a heater receiving part is provided on a heater cover, in the ice maker according to another embodiment of the present invention.

Referring to FIG. 6A, the surface type heater 108 may be provided along the longitudinal direction of the ice tray 102 on the outer circumferential surface of the ice tray 106. Referring to FIG. 10A, the heater receiving part 106 may be provided at a central portion of the ice tray 102 in the outer circumferential surface of the ice tray 102 having the semi-circular arc shape. The region of the ice tray 102 facing the surface type heater 108 in the heater receiving part 106 may be provided in a plane.

The heater cover 143 includes a base plate 143-1 provided under the ice tray 102, a first side plate 143-2 extending from one side of the base plate 143-1 toward one side of the outer circumferential surface of the ice tray 102, a second side plate 143-3 extending from the other side of the base plate 143-1 toward the other side of the outer circumferential surface of the ice tray 102, and a support plate 143-4 extending from a central portion of the base plate 143-1 toward the ice tray 102. Here, the heater pressing part 116 may be provided to press the surface type heater 108 above the support plate 143-4. The heater pressing part 116 may extend laterally from the support plate 143-4 to correspond to the surface type heater 108. At this point, a first cold air flow passage S1 is provided between the support plate 143-4 and the first side plate 143-2 and a second cold air flow passage S2 is provided between the support plate 143-4 and the second side plate 143-3.

FIG. 10B is a view illustrating another embodiment of the heater cover 143. Referring to FIG. 10B, the heater cover 143 may include the base plate 143-1 provided under the ice tray 102, the first side plate 143-2 extending from one side of the base plate 143-1 toward one side of the outer circumferential surface of the ice tray 102, and the second side plate 143-3 extending from the other side of the base plate 143-1 toward the other side of the outer circumferential surface of the ice tray 102.

Here, the heater pressing part 116 may be provided to press the surface type heater by allowing the base plate 143-1 corresponding to the heater receiving part (or surface type heater 108) to protrude toward the ice tray 102. The first cold air flow passage S1 is provided between the heater pressing part 116 and the first side plate 143-2 and the second cold air flow passage S2 is provided between the heater pressing part 116 and the second side plate 143-3.

Figure 11:
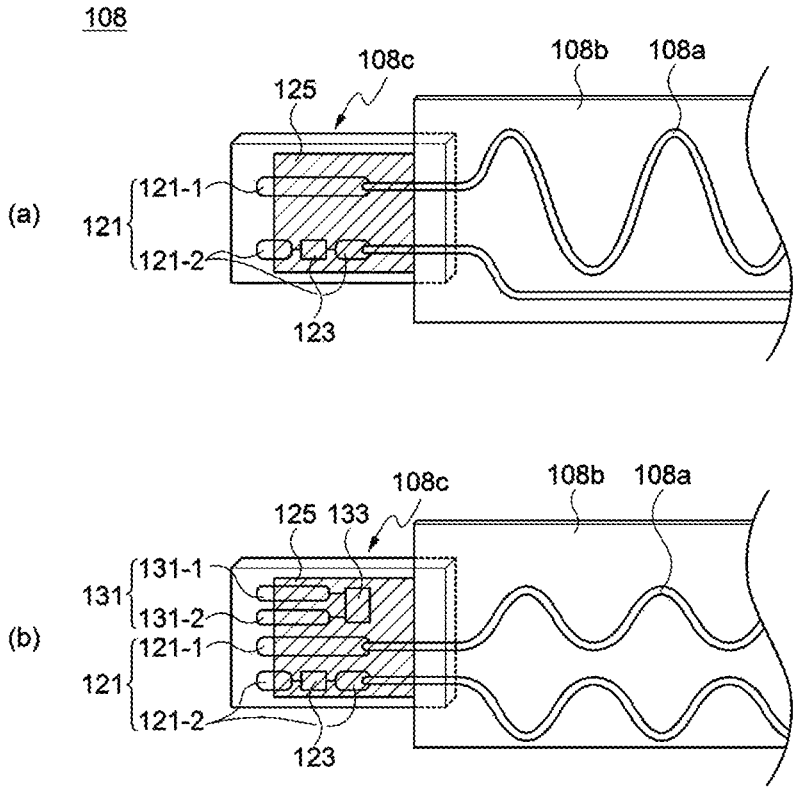
FIG. 11 is a view illustrating a surface type heater, in the ice maker according to the embodiment of the present invention.

FIG. 11 is a view illustrating a surface type heater, in the ice maker according to the embodiment of the present invention.

Referring to FIG. 11A, the surface type heater 108 may include the heating element 108*a*, the insulating member 108*b*, and the power connection part 108*c*.

The power connection part 108*c* may be formed of the printed circuit board (PCB) or the metal PCB. The power connection part 108*c* may include a first electrode pad 121, a power interruption unit 123, and an insulating layer 125. The first electrode pad 121 may include a 1-1-th electrode pad 121-1 electrically connected to one end portion of the heating element and a 1-2 electrode pad 121-2 spaced apart from the 1-1-th electrode pad 121-1 and electrically connected to the other end portion of the heating element 108*a*. The first electrode pad 121 may be connected to a connector 110*a* that is provided in the control box 110. The 1-2-th electrode pad 121-2 may be provided to have the portion electrically connected to the other end portion of the heating element 108*a* and the portion connected to the connector 110*a* spaced apart from each other.

The power interruption unit 123 may be provided to electrically connect between the mutually spaced portions of the 1-2-th electrode pads 121-2. However, the present invention is not limited thereto, and therefore the 1-1-th electrode pads 121-1 may be spaced apart from each other and the power interruption unit 123 may be provided to electrically connect between the mutually spaced portions of the 1-1-th electrode pads 121-1. When the power interruption unit 123 serves to interrupt power applied to the heating element 108*a* when the heating element 108*a* exceeds a preset temperature. As the power interruption unit 123, for example, a thermal fuse or a bimetal may be used but the present invention is not limited thereto. In this case, the power interruption unit 123 may be implemented without a separate temperature sensor. In addition, the power interruption unit 123 may interrupt the power applied to the heating element 108*a* when an overcurrent flows in the heating element 108*a*. In this manner, the surface type heater 108 is provided in a modular form including the power connection part 108*c* formed of the PCB or the metal PCB, such that the power interruption unit 123 may be formed in the power connection part 108*c* with a simple structure and circuit.

The insulating layer 125 may be provided on the power connection part 108*c* to surround the heating element 108*a*, the electrode pad 121, and the power interruption unit 123. The insulating layer 125 may serve to protect the heating element 108*a*, the electrode pad 121, and the power interruption unit 123 from the external environment. The insulating layer 125 is not provided at a portion of the electrode pad 121 that is connected to the connector 110*a*.

Referring to FIG. 11B, the power connection part 108*c* of the surface type heater 108 may be provided with a second electrode pad 131 and a temperature sensor 133. The temperature sensor 133 may measure the temperature of the surface type heater 108. The temperature sensor 133 is electrically connected to the second electrode pad 131. Further, the second electrode pad 131 is connected to the connector 110*a* that is provided in the control box 110. The temperature sensor 133 may transmit the measured temperature information to the control unit (not illustrated) through the connector 110*a*. The control unit (not illustrated) may generate a control signal to the power interruption unit 123 to interrupt the power applied to the heating element 108*a* when the temperature of the surface type heater 108 exceeds the preset temperature. At this point, the power interruption unit 123 may be formed of a switch element. Meanwhile, the temperature sensor 133 may be provided to measure the temperature of the ice tray 102.

Meanwhile, an outer cover of the surface type heater 108 may be crosslinked by electron beam irradiation. For example, the insulating member 108*b* of the surface type heater 108 may be provided with a separate insulating layer and the insulating layer may be crosslinked by the electron beam irradiation. Alternatively, the insulating member 108*b* may be made of ethylene vinyl acetate (EVA), polyethylene (PE), or the like which is crosslinked by the electron beam irradiation. For example, when the insulating member 108*b* is made of the polyethylene (PE), if an accelerating electron beam is irradiated to the insulating member 108*b*, H ions are dissociated in a polyethylene chain (PE chain) to generate radicals and the crosslinking proceeds by the bonding of the radicals. At this point, the polyethylene has a network structure due to the bonding of the radicals, such that the heat resistance temperature of the insulating member 108*b* may be improved and the brittleness of the surface type heater 108 may be improved.

Further, the outer cover of the surface type heater 108 may be a shrink tube. For example, the shrink tube may be provided by surrounding the insulating member 108*b* of the surface type heater 108. Alternatively, the shrink tube may be used as the insulating member 108*b*. The shrink tube may be a shrink tube that is crosslinked by the electron beam irradiation.

Figure 12:
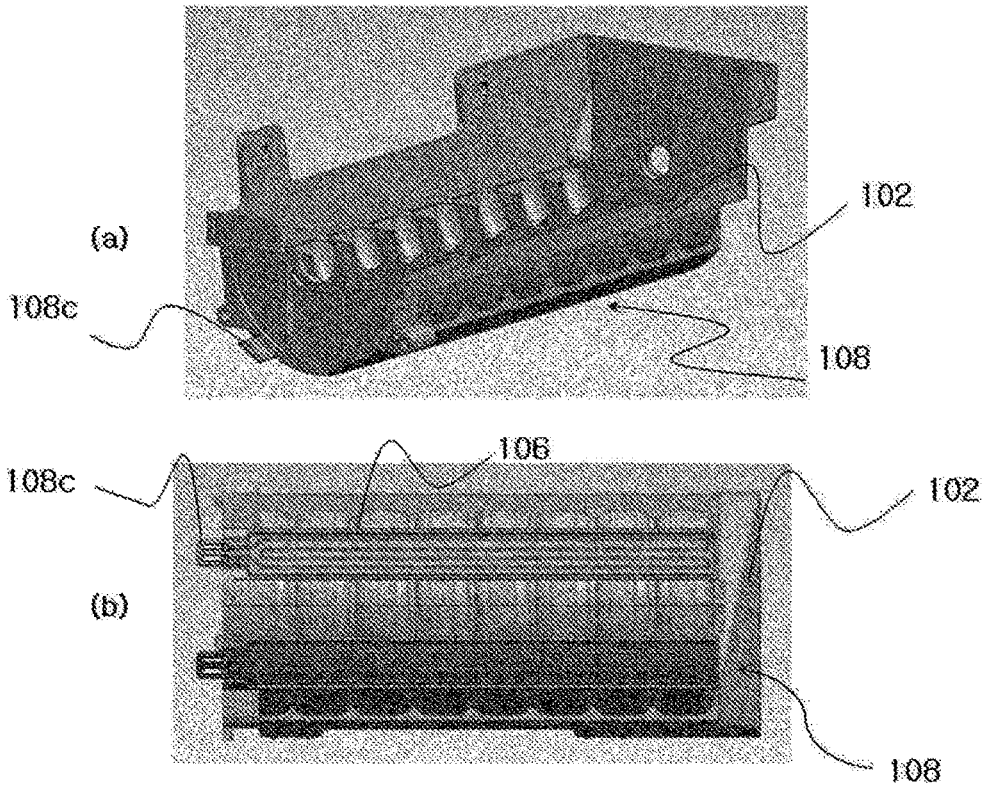
FIG. 12 is a view illustrating a state in which the surface type heater is mounted on the ice tray, in the ice maker according to the embodiment of the present invention.

FIG. 12 is a view illustrating a state in which the surface type heater is mounted on the ice tray, in the ice maker according to the embodiment of the present invention.

Referring to FIG. 12, the surface type heater 108 may be mounted to be received in the ice tray 102 that is provided on the outer circumferential surface of the ice tray 106. The heater receiving part 106 may be provided along the longitudinal direction of the ice tray 102 from one side and the other side of the outer circumference of the ice tray 102. The surface type heater 108 may be provided with the power connection part 108*c* for applying power to the surface type heater 108. At this point, one side of the power connection part 108*c* may be mounted on the outer circumferential surface of the ice tray 102 and the other side of the power connection part 108*c* may protrude toward the control box (not illustrated). The other side of the power connection part 108*c* may be inserted into the control box (not illustrated) to be connected to the connector in the control box (not illustrated). The surface type heater 108 may be formed of the integrated PCB or the metal PCB. That is, only the power connection part 108*c* is formed of the PCB or the metal PCB, but the heating element 108*a* may be provided on the PCB or the metal PCB that extends from the power connection part 108*c*, and the insulating member 108*b* may be provided on the extending PCB or the metal PCB to surround the heating element 108*a*.

Figure 13:
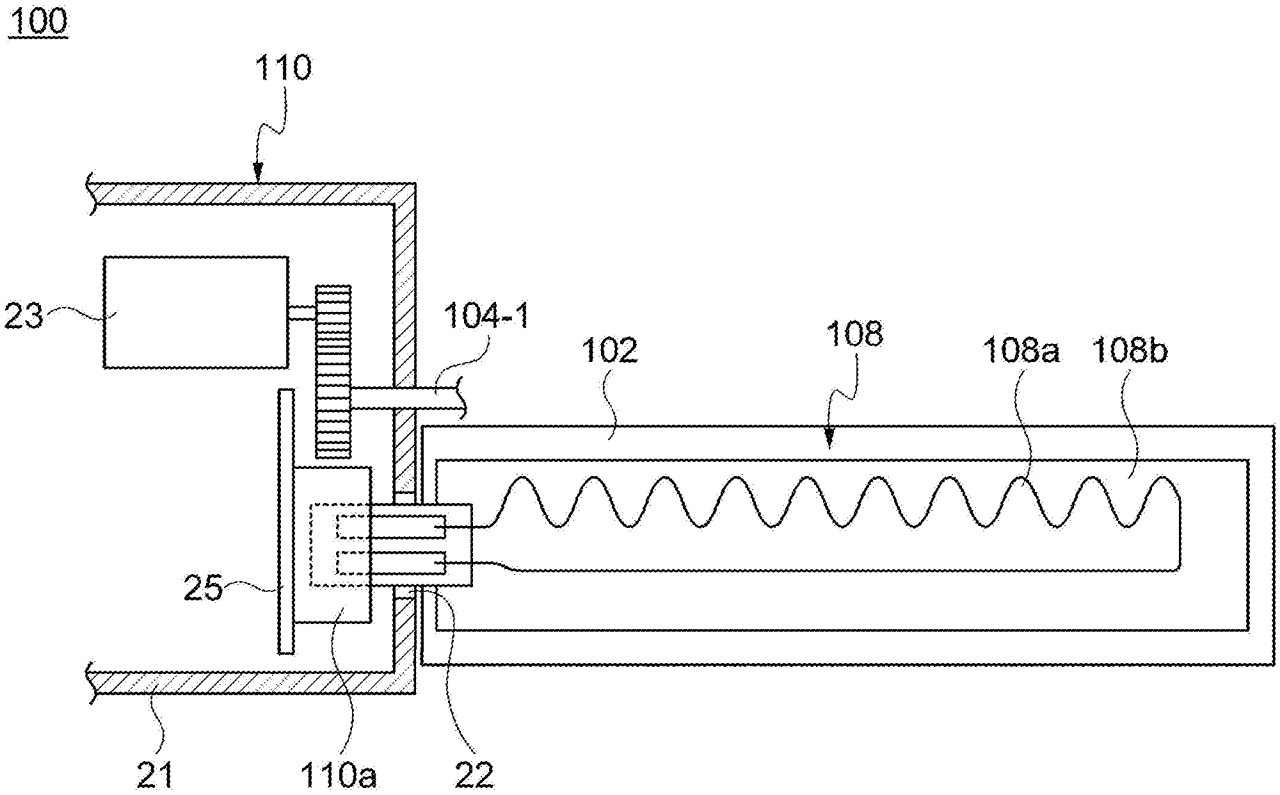
FIG. 13 is a view schematically illustrating a state in which a power connection part of the surface type heater is connected to a connector in a control box, in the ice maker according to the embodiment of the present invention.

FIG. 13 is a view schematically illustrating a state in which a power connection part of the surface type heater is connected to a connector in a control box, in the ice maker according to the embodiment of the present invention.

Referring to FIG. 13, one side of the ice tray 102 may be provided with the control box 110. The ice-separating motor 23 for rotating the ejector shaft 104-1 may be provided in the control box 110. The ice-separating motor 23 and the ejector shaft 104-1 may be connected to each other by a series of gears. The inside of the control box 110 may be provided a main board 25 for controlling the ice maker 100. The main board 25 may be formed of the printed circuit board. The main board 25 may be provided with the connector 110*a*. Here, it is illustrated that the main board 25 is provided with the connector 110*a* but the present invention is not limited thereto, and therefore the connector 110*a* may be provided on a separate printed circuit board for supplying power.

A housing 21 of the control box 110 may be provided with a through hole 22. The through hole 22 may be provided on the surface of the housing 21 facing the ice tray 102. The power connection part 108*c* of the surface type heater 108 is inserted into the through hole 22 to be connected to the connector 110*a*. That is, as illustrated in FIG. 12, one side of the power connection part 108*c* may be mounted on the outer circumferential surface of the ice tray 102 and the other side of the power connection part 108*c* may protrude toward the control box 110. At this point, the other side of the power connection part 108*c* that protrudes toward the control box 110 is inserted into the through hole 22 to be connected to the connector 110*a*. At this point, the electrode pad 108*c*-1 of the power connection part 108*c* may be electrically connected to the connector 110*a*. The surface type heater 108 is directly connected to the connector 110*a* without a separate lead wire (or lead wire).

The connector 110*a* may be electrically connected to a power supplier (not illustrated). Further, the surface type heater 108 may be supplied with power from the connector 110*a*. That is, the power supplied from the connector 110*a* is applied to the power connection part 108*c* to operate the heating element 108*a*.

Figure 14:
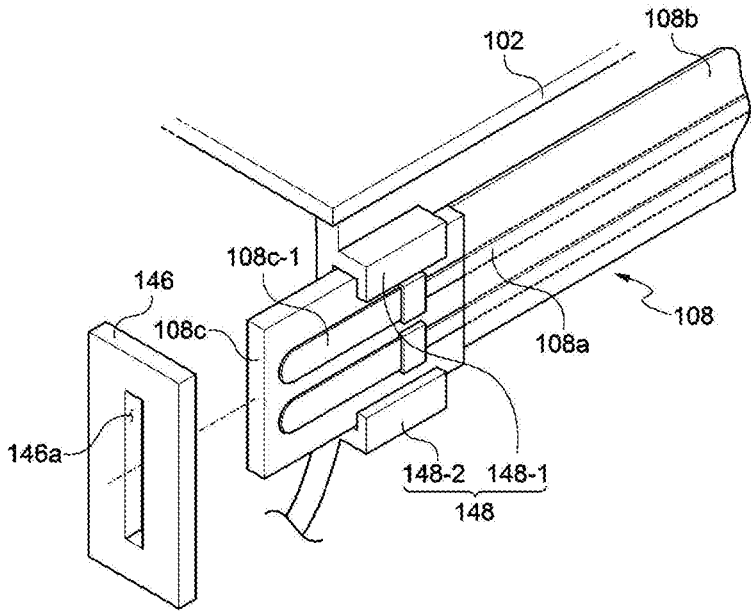
FIG. 14 is a view illustrating a state in which the power connection part of the surface type heater is mounted on the ice tray, in the ice maker according to the embodiment of the present invention.

FIG. 14 is a view illustrating a state in which the power connection part of the surface type heater is mounted on the ice tray, in the ice maker according to the embodiment of the present invention.

Referring to FIG. 14, the outer circumferential surface of the ice tray 102 may be provided with a mounting guide part 148. The mounting guide part 148 may include a first mounting guide part 148-1 and a second mounting guide part 148-2. The first mounting guide part 148-1 may protrude from the outer circumferential surface of the ice tray 102 and be bent downward. As the first mounting guide part 148-1 is bent downward, an inner side thereof is provided with a guide groove. The second mounting guide part 148-2 is provided separately from the first mounting guide part 148-1 under the first mounting guide part 148-1. The second mounting guide part 148-2 may protrude from the outer circumferential surface of the ice tray 102 and be bent upward. As the second mounting guide part 148-2 is bent upward, an inner side thereof is provided with a guide groove. The first mounting guide part 148-1 and the second mounting guide part 148-2 may be provided to be vertically symmetrical to each other. The first mounting guide part 148-1 and the second mounting guide part 148-2 may be provided along the longitudinal direction of the ice tray 102. At least one of the first mounting guide part 148-1 and the second mounting guide part 148-2 may be provided in plural to be spaced apart from the outer circumferential surface of the ice tray 102.

The surface type heater 108 may include the heating element 108*a*, the insulating member 108*b*, and the power connection part 108*c*. The heating element 108*a* and the insulating member 108*b* may be housed in a heater receiving part 106 that is provided in the ice tray 102. The heating element 108*a* is electrically connected to the electrode pad 108*c*-1 that is formed on the power connection part 108*c*. Further, the power connection part 108*c* may be fixedly mounted on the mounting guide part 148. Specifically, the power connection part 108*c* may be inserted between the first mounting guide part 148-1 and the second mounting guide part 148-2 to be fixedly mounted on the outer circumferential surface of the ice tray 102.

Meanwhile, a packing member 146 may be provided between the control box 110 and the ice tray 102 when the power connection part 108*c* is inserted into the connector 110*a* and connected thereto. The packing member 146 may be provided to seal the through-hole 22. That is, when the other side of the power connection part 108*c* that protrudes is inserted into the through hole 22 to be connected to the connector 110*a*, the packing member 146 may be provided to seal the through hole 22. The packing member 146 may be provided to have a surface extending in a crossing direction with respect to the inserting direction of the connector 110*a* of the power connection part 108*c*. The packing member 146 is provided with an insertion hole 146*a* into which an end portion of the power connection part 108*c* is inserted and fitted. The packing member 146 prevents the cold air or the moisture of the ice tray 102 from flowing into the control box 110 by sealing the through hole 22 when the power connection part 108*c* is connected to the connector 110*a*. Here, it is illustrated that the packing member 146 has a rectangular shape but the present invention is not limited thereto, and therefore the packing member 146 may have a shape that may seal the through hole 22 according to the shape of the through hole 22.

Figure 15:
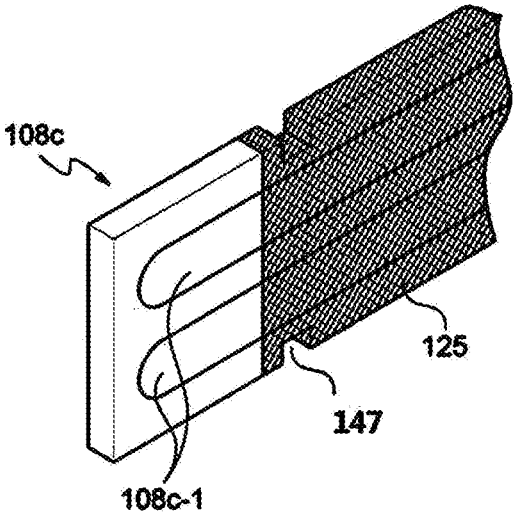
FIG. 15 is a view illustrating a state in which upper and lower long sides of the power connection part are each provided with concave grooves, in the surface type heater according to the embodiment of the present invention.

Further, 15, as illustrated in FIG. 15, the power connection part 108*c* may be provided with concave grooves 147 formed at each of upper and lower long sides so that the packing member 146 fitted into the power connection part 108*c* is caught in the concave groove 147. That is, the packing member 146 may be inserted and fitted into the power connection part 108*c* by an insertion hole 146*a*. At this point, the upper and lower ends of the insertion hole 146*a* of the packing member 146 may each be caught in the concave grooves 147 that are formed in the upper and lower long sides of the power connection part 108*c*. Here, a length of the insertion hole 146*a* may be slightly shorter than a cross-sectional length of the power connection part 108*c*.

With such a configuration, the position of the packing member 146 may be fixedly maintained on the power connection part 108*c* when the surface type heater 108 is fitted into the connector 110*a* or when the surface type heater 108 is pulled out from the connector 110*a*. Thereby, even if the surface type heater 108 is pulled out from the connector 110*a* for repair or the like and then inserted into the connector 110*a* again, there is no change in the position of the packing member 146, such that the packing member 146 may accurately seal the through hole 22.

The concave grooves 147 may be formed in each of the upper and lower long sides (edge portions) of the power connection part 108*c* as described above, but only one of the two grooves 147 may be formed and may also be formed on one or both surfaces of the power connection part 108*c* in the form of a groove or a cutout part. Further, referring to FIG. 15, the insulating layer 125 is provided to further extend toward the end portion of the power connection part 108*c* than the position where the packing member 146 is mounted on the power connection part 108*c*, such that the electrode pad 108*c*-1 may be prevented from being exposed to the outside air when the surface type heater 108 is connected to the connector 110*a*.

In the ice maker 100 according to the embodiment of the present invention, the surface type heater 108 mounted on the ice tray 102 may be easily inserted into or separated from the connector 110*a* in the control box 110. As a result, the mounting of the heater 108 is facilitated during the assembly of the ice maker 100 and the repair or replacement of the surface type heater 108 which may occur during the use of the ice maker 100 may be facilitated.

Figure 16:
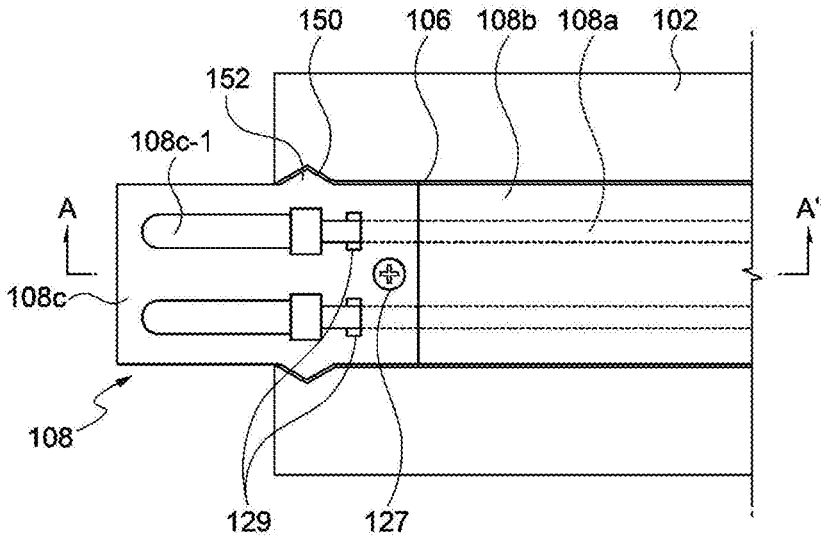
FIG. 16 is a view illustrating another embodiment in which the power connection part of the surface type heater is mounted on the ice tray, in the ice maker according to the embodiment of the present invention.
Figure 17:
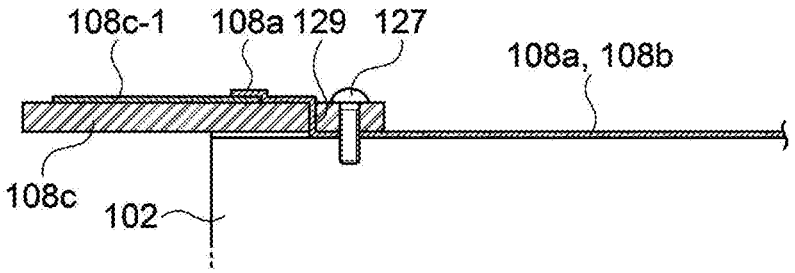
FIG. 17 is a cross-sectional view taken along the line A-A' of FIG. 16.

FIG. 16 is a view illustrating another embodiment in which the power connection part of the surface type heater is mounted on the ice tray, in the ice maker according to the embodiment of the present invention and FIG. 17 is a cross-sectional view taken along the line A-A' of FIG. 16.

Referring to FIGS. 16 and 17, the heater tray 102 may be provided on the outer circumferential surface of the ice tray 102 along the longitudinal direction of the ice tray 102. At this point, the heater receiving part 106 may be provided along the longitudinal direction of the ice tray 102 from one end portion (i.e., end facing the control box 110) of the ice tray 102 toward the other end portion of the ice tray 102. The heating element 108*a* and the insulating member 108*b* of the surface type heater 108 may be received in the heater receiving part 106. Further, a portion of the power connection part 108*c* of the surface type heater 108 may be received in the heater receiving part 106. The portion into which the power connection part 108*c* of the heater receiving part 106 is inserted may be provided with mounting grooves 150 that extend from the heater receiving part 106.

Further, both sides of the power connection part 108*c* may be provided with protrusions 152 corresponding to the mounting grooves 150. As a result, the surface type heater 108 may be fixed with respect to the insertion direction (or opposite direction thereto) into the connector 110*a* of the power connection part 108*c*.

Here, the power connection part 108*c* may be coupled to the ice tray 102 by a coupling member 127. For example, a bolt or a screw may be used as the coupling member 127. That is, the power connection part 108*c* may be screw-coupled to the ice tray 102 by the coupling member 127. The coupling member 127 may penetrate the power connection part 108*c* to couple the power connection part 108*c* to the ice tray 102. In addition, the power connection part 108*c* may be provided with an insertion hole 129. The insertion hole 129 may be provided to penetrate through the power connection part 108*c* in a thickness direction of the power connection part 108*c*.

The heating element 108*a* and the insulating member 108*b* of the surface type heater 108 may be adhered to the outer circumferential surface of the ice tray 102. One end portion of the heating element 108*a* and one end portion of the insulating member 108*b* may be adhered to the ice tray 102 at the lower portion of the power connection part 108*c* by the pressing by the power connection part 108*c*. Further, one end portion of the heating element 108*a* may be inserted into the insertion hole 129 to be exposed to the outside and then may be electrically connected to the electrode pad 108*c*-1. In this case, it is possible to stably maintain the electrical connection between the heating element 108*a* and the electrode pad 108*c*-1 while adhering the entire region of the heating element 108*a* and the insulating member 108*b* to the ice tray 102. Meanwhile, the insulating layer (not illustrated) may be provided to surround a portion of the heating element 108*a* and the electrode pad 108*c*-1 that are exposed to the outside.

Figure 18:
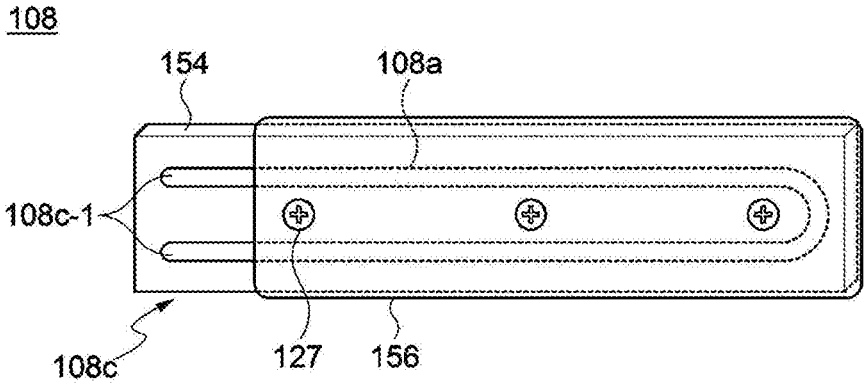
FIG. 18 is a view illustrating a surface type heater according to the embodiment of the present invention.
Figure 18:
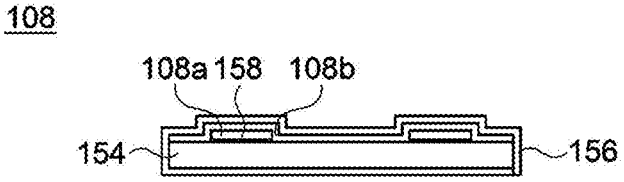

FIG. 18 is a view illustrating the surface type heater according to the embodiment of the present invention.

Referring to FIG. 18, the entire region of the surface type heater 108 may be formed of a printed circuit board (PCB) (or a metal PCB) 154. That is, a base member of the surface type heater 108 may be formed of the PCB (or a metal PCB) 154. At this point, one surface of the PCB 154 may be provided with the electrode pad 108*c*-1 and the heating element 108*a*. The electrode pad 108*c*-1 and the heating element 108*a* may be integrally formed, but the present invention is not limited thereto. Further, the heating element 108*a* may be formed of a metal thin film having a thickness greater than 0 and less than or equal to 0.5 mm and then adhered to one side of the PCB 154 by an adhesive 158. One side of the PCB 154 may be provided with the insulating member 108*b* to surround the heating element 108*a*. A portion connected to the connector 110*a* of the electrode pad 108*c*-1 is exposed to the outside. The portion (i.e., portion other than the electrode pad 108*c*-1 connected to the connector 110*a*) where the heating element 108*a* of the surface type heater 108 is formed may be surrounded with a shrink tube 156. The shrink tube 156 may be crosslinked by the electron beam irradiation. The surface type heater 108 may be provided with at least one coupling member 127 that penetrates through the surface type heater 108. The coupling member 127 serves to couple the surface type heater 108 to the ice tray 102 when the surface type heater 108 is mounted on the ice tray 102.

Figure 19:
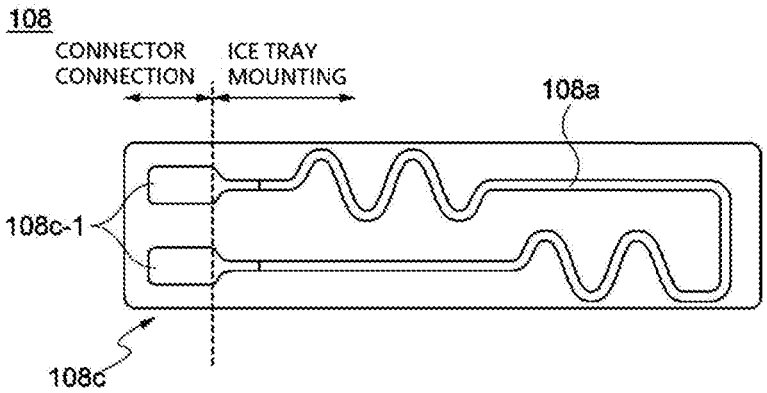
FIG. 19 is a view illustrating a surface type heater according to another embodiment of the present invention.

FIG. 19 is a view illustrating a surface type heater according to another embodiment of the present invention.

Referring to FIG. 19, the electrode pad 108*c*-1 provided on the power connection part 108*c* of the surface type heater 108 may be formed to have a different width or area according to the position. For example, the portion of the electrode pad 108*c*-1 connected to the connector 110*a* may be provided to have an area or a width larger than that of the portion where the ice tray 102 is mounted. Further, the width of the electrode pad 108*c*-1 may be larger than that of the heating element 108*a*. That is, FIG. 19 illustrates that the portion of the electrode pad 108*c*-1 connected to the heating element 108*a* is formed to have the same width as that of the heating element 108*a* but the present invention is not limited thereto, and therefore the electrode pad 108*c*-1 may have a width larger than that of the heating element 108*a*.

Meanwhile, the surface type heater 108 may have a heating density that is changed depending on the position of the surface type heater 108. That is, the surface type heater 108 makes an area of the heating element 108*a* per unit area different, and thus may have the heating density that is changed depending on the position of the surface type heater 108.

Figure 20:
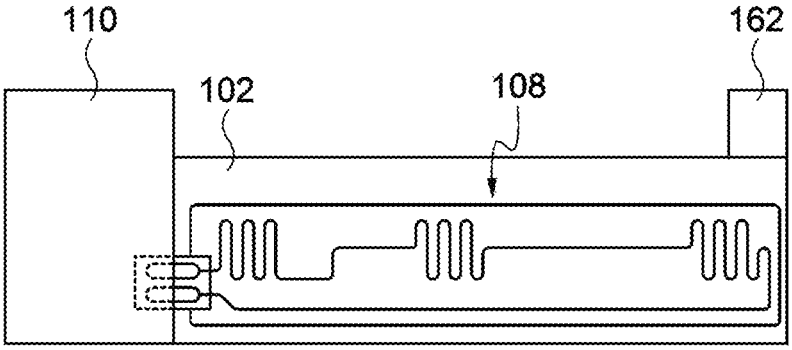
FIG. 20 is a view schematically illustrating the state in which the surface type heater according to the embodiment of the present invention is mounted on the ice tray.
Figure 20:
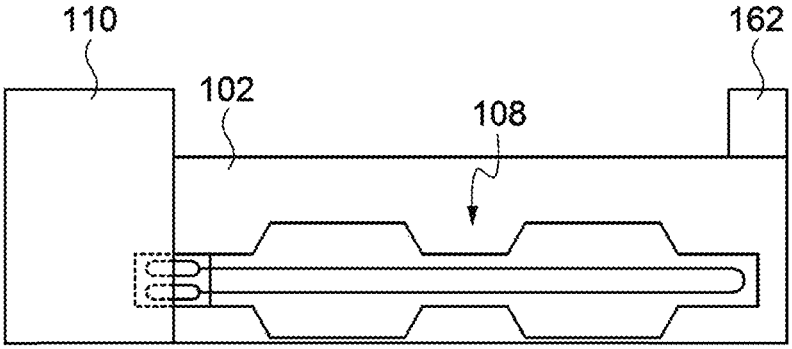

FIG. 20 is a view schematically illustrating the state in which the surface type heater according to the embodiment of the present invention is mounted on the ice tray.

Referring to FIG. 20A, the surface type heater 108 may be provided on the outer circumferential surface of the ice tray 106. The surface type heater 108 may be provided along the longitudinal direction of the ice tray 102 from one end portion of the ice tray 102 to the other end portion thereof. One end portion of the ice tray 102 may be provided with the control box 110 that is opposite to the ice tray 102. The upper side of the other end portion of the ice tray 102 may be provided with a water supply part 162 that supplies ice-making water into the ice tray 102.

Here, the surface type heater 108 may have the heating density that is changed according to the position corresponding to the ice tray 102. For example, the portions of the surface type heater 108 corresponding to one end portion and the other end portion of the ice tray 102 may have a heating density (for example, density per unit area of the heating element) higher than other portions. One end portion of the ice tray 102 is provided with the same structure as the control box 110 and the other end portion of the ice tray 102 is provided with the same structure as the water supply part 162, and therefore when the ice tray 102 is heated with the surface type heater 108, heat may be leaked to other structures. Therefore, the portions of the surface type heater 108 corresponding to one end portion and the other end portion of the ice tray 102 have the heating density higher than that of other portions, such that ice may be uniformly separated from the entire region of the ice tray 102. Further, the portion of the surface type heater 108 corresponding to the central portion of the ice tray 102 may have the heating density higher or lower than that of other portions.

Referring to FIG. 20B, the surface type heater 108 may have an area (or heating area) that is changed according to the position of the surface type heater 108 corresponding to the ice tray 102. That is, the area or the heating area of the surface type heater 108 may be changed according to the position of the surface type heater 108 so that ice may be uniformly separated from the entire area of the ice tray 102. At this point, in the region where the area of the surface type heater 108 is narrow, the density of the heating element 108*a* may be increased and thus the heating density may be further increased. Further, in the region where the area of the surface type heater 108 is wide, the density of the heating element 108*a* may be decreased and thus the heating density may be further decreased. However, the present invention is not limited thereto, and therefore in the region where the area of the surface type heater 108 is narrow, the density of the heating element 108*a* may be decreased and in the region where the area of the surface type heater 108 is wide, the density of the heating element 108*a* may be further increased.

Figure 21:
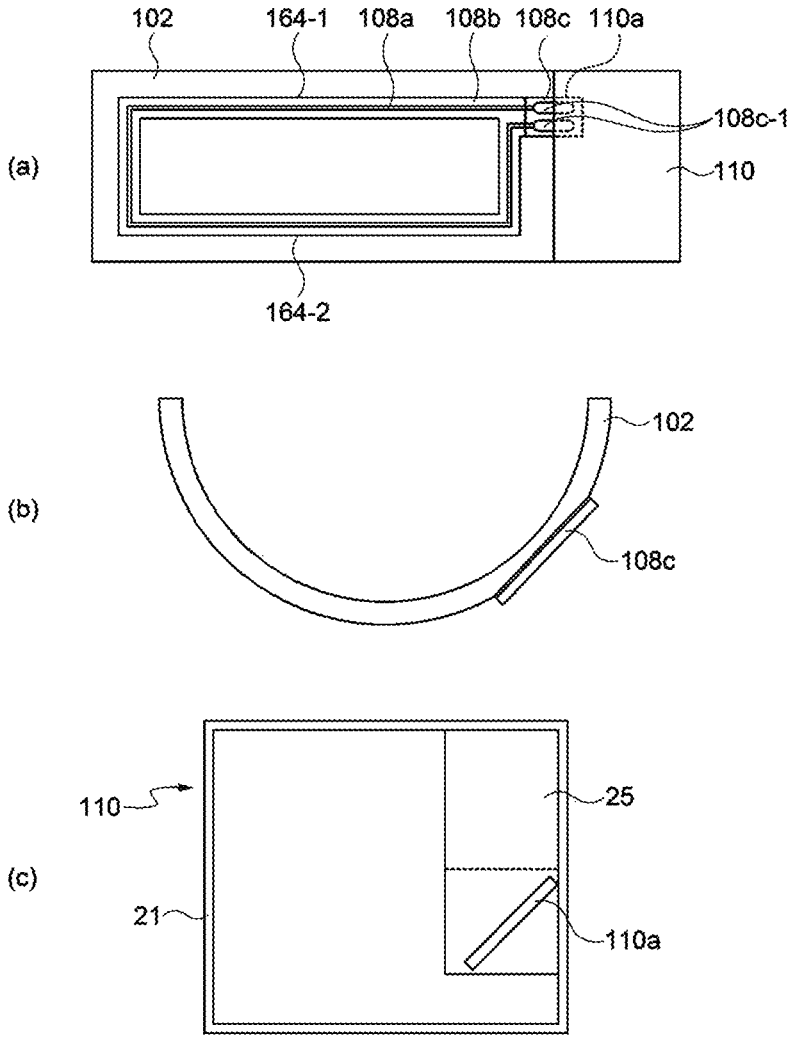
FIG. 21 is a view schematically illustrating the state in which the surface type heater mounted on the ice tray is connected to the connector in the control box, in the ice maker according to another embodiment of the present invention.

FIG. 21 is a view schematically illustrating the state in which the surface type heater mounted on the ice tray is connected to the connector in the control box, in the ice maker according to another embodiment of the present invention. FIG. 21A is a bottom view illustrating the ice maker, FIG. 21B is a front view of one end portion of the ice tray, and FIG. 21C is a front view of the inside of the control box.

Referring to FIG. 20A, the surface type heater 108 may be provided on the outer circumferential surface of the ice tray 106. The power connection part 108*c* of the surface type heater 108 may be provided so that one end portion thereof protrudes from one side (right with respect to the center of the ice tray 102 in FIG. 21B) of the outer circumferential surface of the ice tray 102 toward the control box 110. The surface type heater 108 may include a surface type heater first part 164-1 provided on one side of the outer circumferential surface of the ice tray 102 along the longitudinal direction of the ice tray 102 and a surface type heater second part 164-2 provided on the other side of the outer circumferential surface of the ice tray 102 along the longitudinal direction of the ice tray 102. The region between the surface type heater first part 164-1 and the surface type heater second part 164-2 in the ice tray 102 may be exposed to the outside to form the cold air contact section.

One end portion of the surface type heater first part 164-1 and one end portion of the surface type heater second part 164-2 are connected to the power connection part 110*c*. At this point, the surface type heater second part 164-2 may be bent from the other side of the outer circumferential surface of the ice tray 102 toward one side to be connected to the power connection part 110*c*. In this manner, the heating element 108*a* of the surface type heater 108 may be branched in plural at the power connection part 108*c*.

The other end portion of the surface type heater first part 164-1 and the other end portion of the surface type heater second part 164-2 may be connected to each other. For example, the other end portion of the surface type heater first part 164-1 may be bent from one side of the outer circumferential surface of the ice tray 102 toward the other side to be connected to the other end portion of the surface type heater second part 164-2. Alternatively, the other end portion of the surface type heater second part 164-2 may be bent from the other side of the outer circumferential surface of the ice tray 102 toward one side to be connected to the other end portion of the surface type heater first part 164-1. However, the present invention is not limited thereto, and therefore the other end portion of the surface type heater first part 164-1 and the other end portion of the surface type heater second part 164-2 may be spaced apart from each other. In this case, the surface type heater first part 164-1 and the surface type heater second part 164-2 may be electrically connected to the electrode pads of a cathode and an anode of the power connection part 108*c*, respectively.

The surface type heater 108 may be provided on the outer circumferential surface of the ice tray 102 in a closed loop form or an open loop form in which a portion of the surface type heater 108 is open. In this case, the contact area (or heating area) with the ice tray 102 may be widened by one surface type heater 108, thereby ensuring the cold air contact section.

Meanwhile, the inside of the control box 110 may be provided with the printed circuit board 25 on which the connector 110*a* is formed. The printed circuit board 25 may be a main board provided with a control unit (not illustrated) for controlling the overall operation of the ice maker 100. The printed circuit board 25 may be provided at a side corresponding to the power connection part 108*c* in the housing 21 of the control box 110. That is, in FIG. 21C, the printed circuit board 25 may be provided to be biased to the right with respect to the center of the housing 21.

As described above, the power connection part 108*c* of the surface type heater 108 is protruded from one side of the outer circumference of the ice tray 102 toward the control box 110 and the printed circuit board 25 is provided at a side corresponding to the power connection part 108*c* in the control box 110, such that the printed circuit board 25 may be provided with the connector 110*a* connected to the power connection part 108*c* without separately extending the printed circuit board 25 or changing the size and form of the printed circuit board 25. That is, if the power connection part 108*c* of the surface type heater 108 is provided at the center of the ice maker 102 on the outer circumferential surface of the ice maker 102, the corresponding portion of the printed circuit board 25 for the electrical connection with the power connection part 108*c* needs to extend toward the central portion of the control box 110. In this case, since the printed circuit board 25 is out of the standardized shape, the printed circuit board 25 needs to be designed separately and it is difficult to recycle raw materials remaining after manufacturing the printed circuit board 25.

Therefore, according to the embodiment of the present invention, the power connection part 108*c* of the surface type heater 108 is provided to be biased from the center of the ice maker 102 toward one side and the printed circuit board 25 is provided at the side corresponding to the power connection part 108*c* in the control box 110, such that the structure the printed circuit board 25 may be simplified while the printed circuit board 25 is connected to the power connection part 108*c*. Here, it is described that the power connection part 108*c* is provided on one side of the outer circumferential surface of the ice tray 102 but the present invention is not limited thereto, and therefore the power connection part 108*c* is provided to be biased to the right or the left with respect to the center of the ice tray 10 in FIG. 21B.

Figure 22:
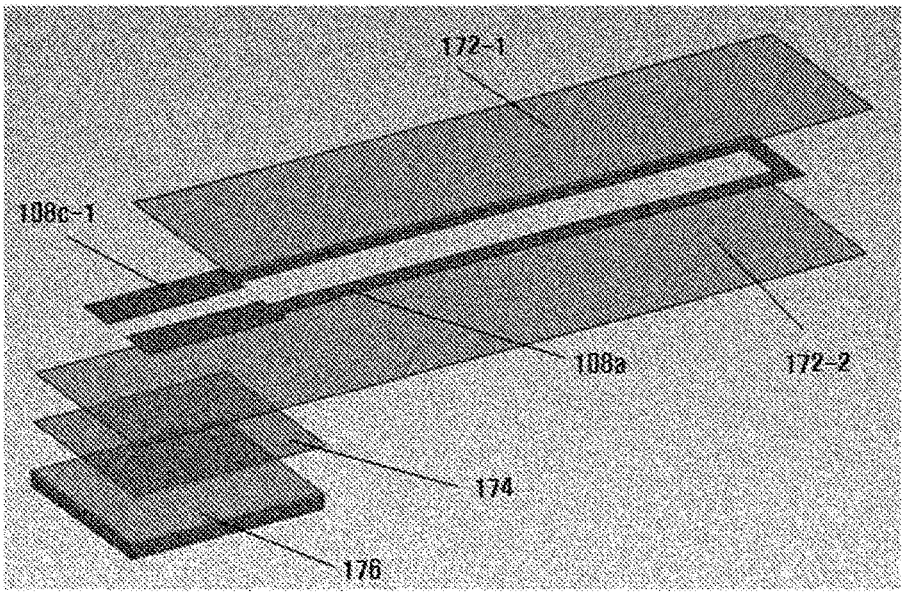
FIGS. 22 to 24 are views illustrating a surface type heater according to another embodiment of the present invention.

FIG. 22 is an exploded perspective view illustrating a surface type heater according to another embodiment of the present invention.

Referring to FIG. 22, the surface type heater 108 may include the heating element 108*a* and the electrode pad 108*c*-1 formed of the metal thin film. At this point, the heating element 108*a* and the electrode pad 108*c*-1 may be integrally formed. The upper surface of the heating element 108*a* may be provided with a first insulating film 172-1. The lower surface of the heating element 108*a* and the electrode pad 108*c*-1 may be provided with a second insulating film 172-2. That is, the first insulating film 172-1 and the second insulating film 172-2 may be provided to surround the heating element 108*a*. Further, the upper surface of the electrode pad 108*c*-1 is exposed to the outside. The first insulating film 172-1 and the second insulating film 172-2 may be made of a polyimide material.

An adhesive member 174 and a support plate 176 may be sequentially provided under the second insulation film 172-2 provided on the lower surface of the electrode pad 108*c*-1. The adhesive member 174 serves to adhere the second insulating film 172-2 and the support plate 176 to each other. Here, the structures (i.e., the second insulating film 172-2, the adhesive member 174, and the support plate 176) provided under the electrode pad 108*c*-1 and the electrode pad 108*c*-1 form the power connection part 108*c*. The support plate 176 serves to support the structures provided on the support plate 176. The support plate 176 may be formed of PCB, metal PCB, plastic, or the like.

Figure 23:
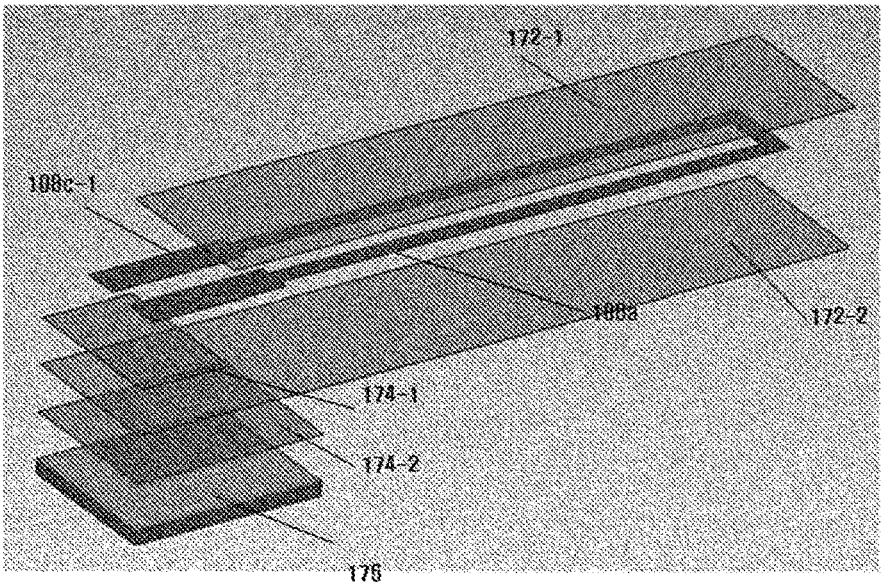

Further, as illustrated in FIG. 23, the first adhesive member 174-1 is provided between the electrode pad 108*c*-1 and one surface of the second insulating film 172-2, and the second adhesive member 174-2 may be provided between the other surface of the second insulating film 172-2 and the support plate 176. The electrode pad 108*c*-1 and the second insulating film 172-2 may be bonded to each other by the first adhesive member 174-1 and the second insulating film 172-2 and the support plate 176 may be bonded to each other by the second adhesive member 174-2.

Figure 24:
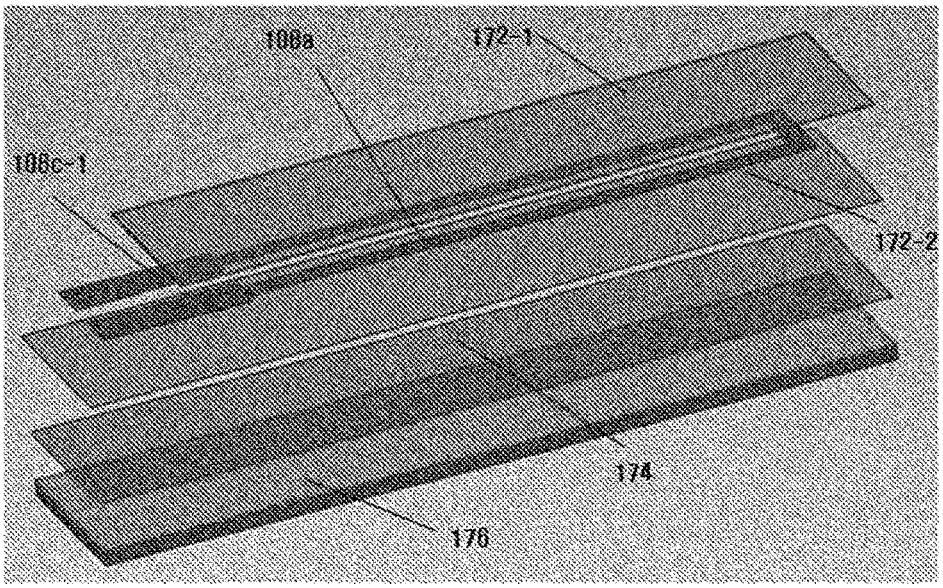

Further, as illustrated in FIG. 24, the adhesive member 174 and the support plate 176 may be provided to extend in the longitudinal direction of the surface type heater 108. That is, the adhesive member 174 and the support plate 176 may extend toward the heating element 108*a* to support the heating element 108*a*.

Figure 25:
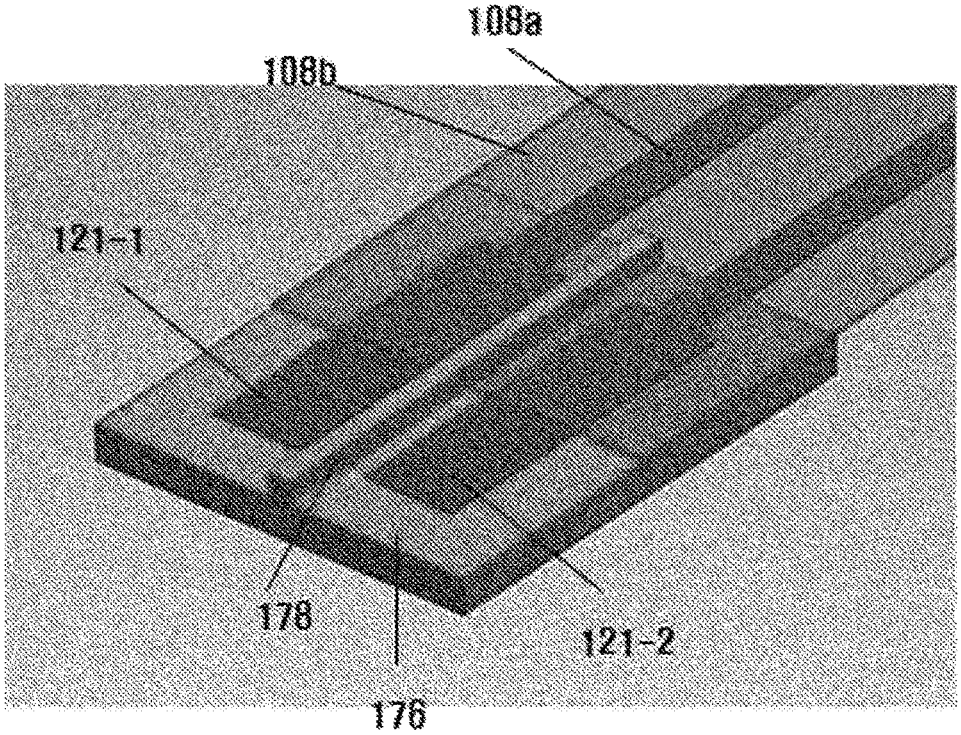
FIG. 25 is a view illustrating a surface type heater according to another embodiment of the present invention.

FIG. 25 is a view illustrating a surface type heater according to another embodiment of the present invention.

Referring to FIG. 25, one end portion of the heating element 108*a* may be connected to the 1-1-th electrode pad 121-1 on the upper portion of the support plate 176. The other end portion of the heating element 108*a* may be connected to the 1-2-th electrode pad 121-2 on the upper portion of the support plate 176. Here, the support plate 176 may be provided with a partition 178 between the 1-1-th electrode pad 121-1 and the 1-2-th electrode pad 121-2. The partition 178 may protrude from the support plate 176 and may be provided along the longitudinal direction of the support plate 176 from one end portion of the support plate 176 to the other end portion thereof. However, the present invention is not limited thereto but the partition 178 may be provided on the support plate 176 in the form of the groove. The partition 178 serves to electrically and physically separate (or block) between the 1-1-th electrode pad 121-1 and the 1-2-th electrode pad 121-2.

Figure 26:
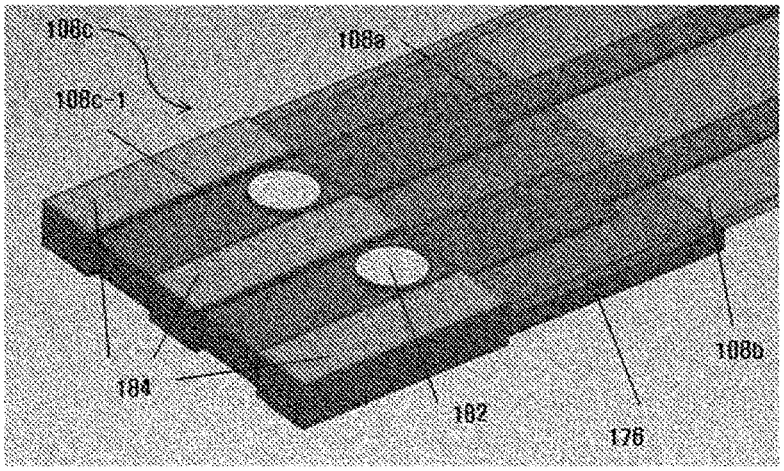
FIG. 26 is a view illustrating a surface type heater according to another embodiment of the present invention.
Figure 26:
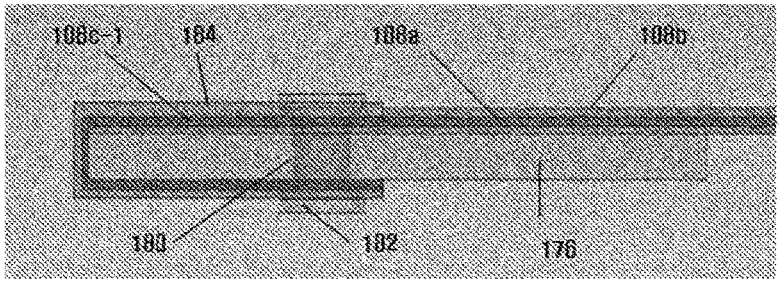

FIG. 26 is a view illustrating a surface type heater according to another embodiment of the present invention. FIG. 26A is a perspective view of a surface type heater according to another embodiment of the present invention and FIG. 26B is a cross-sectional view of a surface type heater according to another embodiment of the present invention.

Referring to FIG. 26, the electrode pad 108*c*-1 may be connected to the heating element 108*a* on the upper surface of the support plate 176. The electrode pad 108*c*-1 may be provided from the upper surface of the support plate 176 to the end of the support plate 176 along the longitudinal direction (i.e., direction in which the electrode pad 108-*c* is connected to the connector 110*a*) of the support plate 176. Further, the electrode pad 108*c*-1 may be provided to extend by a predetermined length from the end of the support plate 176 to a lower surface of the support plate 176. A side portion of the electrode pad 108*c*-1 on the support plate 176 may be provided with an electrode pad guide part 184 along the electrode pad 108*c*-1. The electrode pad guide part 184 may be provided between the electrode pads 108*c*-1 and on one side of the electrode pad 108*c*-1. The electrode pad guide part 184 may protrude from the surface of the support plate 176 by a predetermined height. For example, the electrode pad guide part 184 may protrude from the surface of the support plate 176 above the thickness of the electrode pad 108*c*-1. The electrode pads 108*c*-1 provided on the upper and lower surfaces of the support plate 176 may be fixed by a coupling member 182 that penetrates through the power connection part 108*c*. The power connection part 108*c* may be provided with a through hole 180 that penetrates through the power connection part 108*c*. The through hole 180 may penetrate through the electrode pad 108*c*-1 provided on the upper surface of the support plate 176, the support plate 176, and the electrode pad 108*c*-1 provided on the lower surface of the support plate 176. The coupling member 182 may be inserted into the through hole 180 to couple the electrode pad 108*c*-1 to the support plate 176. As the coupling member 182, a rivet, a bolt, an eyelet, a screw, or the like may be used.

Figure 27:
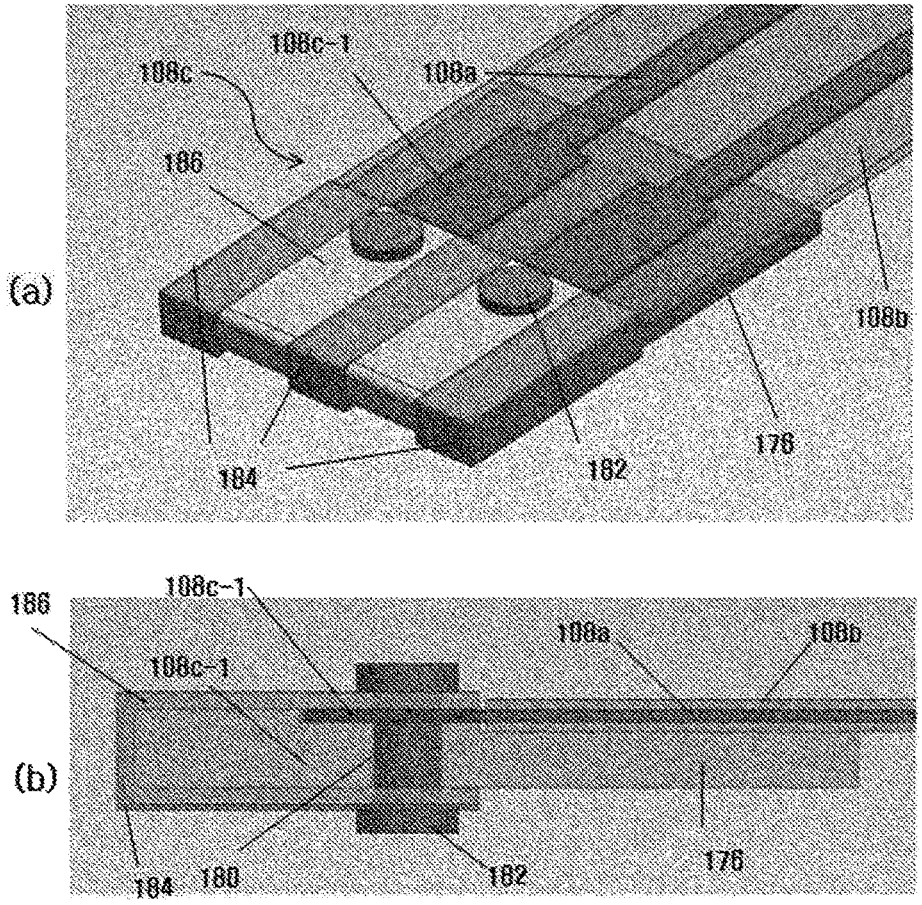
FIG. 27 is a view illustrating a surface type heater according to another embodiment of the present invention.

FIG. 27 is a view illustrating a surface type heater according to another embodiment of the present invention. FIG. 27A is a perspective view of a surface type heater according to another embodiment of the present invention and FIG. 27B is a cross-sectional view of a surface type heater according to another embodiment of the present invention. Here, the difference from the embodiment illustrated in FIG. 26 will be described.

Referring to FIG. 27, the electrode pad 108*c*-1 may be connected to the heating element 108*a* on one side of the upper surface of the support plate 176. Further, a metal connecting member 186 may be electrically connected to the electrode pad 108*c*-1 while being inserted into the end portion of the support plate 176. The metal connecting member 186 may be formed in a "⊂" shape. One end portion of the metal connecting member 186 is electrically connected to the electrode pad 108*c*-1 on the upper surface of the support plate 176. The metal connecting members 186 may be provided up to the end of the support plate 176 along the longitudinal direction (i.e., direction in which the metal connecting member 186 is connected to the connector 110*a*) of the support plate 176. Further, the metal connecting member 186 may be provided to extend by a predetermined length from the end of the support plate 176 to the lower surface of the support plate 176. The metal connecting member 186 may be provided to be vertically symmetrical to each other, having the support plate 176 disposed therebetween. The metal connecting members 186 provided on the upper and lower surfaces of the support plate 176 may be fixed by the coupling member 182 that penetrates through the power connection part 108*c*. The metal connecting member may be thicker than the thin electrode pad 108*c*-1. When the metal connecting member 186 is connected to the connector 110*a*, the heating may be more effectively suppressed than when the thin electrode pad 108*c*-1 is connected to the connector 110*a*.

Figure 28:
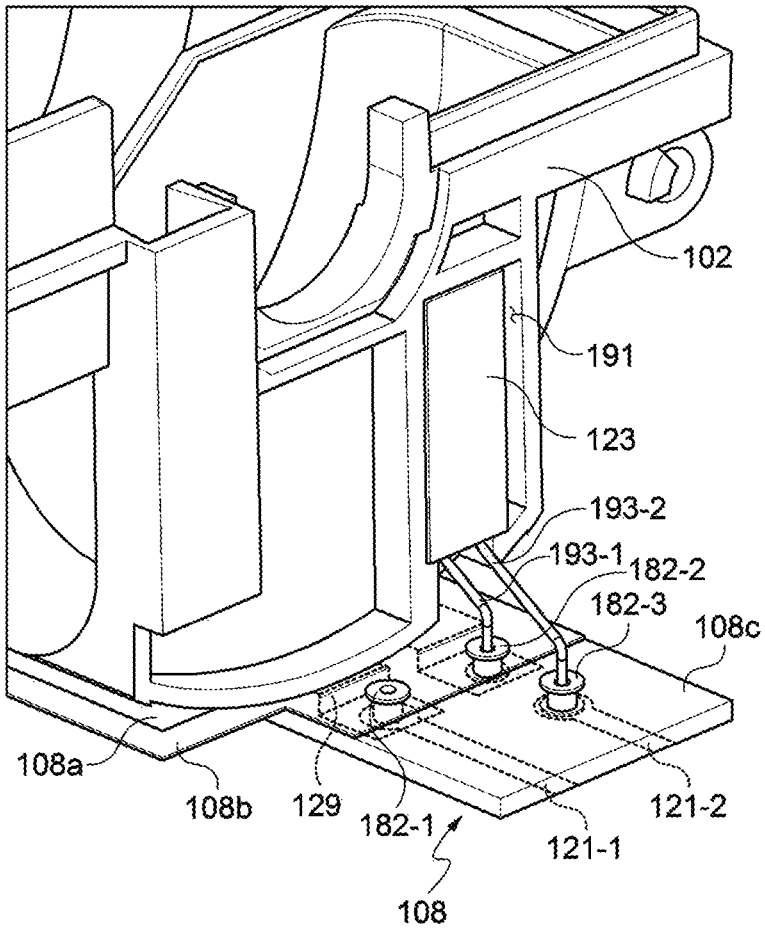
FIG. 28 is a view illustrating a state in which a power interruption unit is mounted on the ice tray, in the ice maker according to the embodiment of the present invention.

FIG. 28 is a view illustrating a state in which a power interruption unit is mounted on the ice tray, in the ice maker according to the embodiment of the present invention.

Referring to FIG. 28, the 1-1-th electrode pad 121-1 and the 1-2-th electrode pad 121-2 may be provided on the lower surface of the power connection part 108*c* of the surface type heater 108. The end portions of the heating element 108*a* and the insulating member 108*b* of the surface type heater 108 may be fixed on the upper surface of the power connection part 108*c*. At this point, the heating element 108*a* may be inserted into the lower surface of the power connection part 108*c* from the upper surface of the power connection part 108*c* through the insertion hole 129 provided on the power connection part 108*c*.

One end portion of the heating element 108*a* may be electrically connected to the 1-1-th electrode pad 121-1 on the lower surface of the power connection part 108*c*. The portion corresponding to one end portion of the heating element 108*a* may be provided with the first coupling member 182-1 that penetrates through the power connection part 108*c* from the insulation member 108*b* positioned on the upper surface of the power connection part 108*c*. The first coupling member 182-1 serves to stabilize the electrical connection between one end portion of the heating element 108*a* and the 1-1-th electrode pad 121-1 while fixing the insulating member 108*b* and the heating element 108*a* to the power connection part 108*c*.

The other end portion of the heating element 108*a* may be provided on the lower surface of the power connection part 108*c* to be spaced apart from the 1-2-th electrode pad 121-2. The portion corresponding to one end portion of the heating element 108*a* may be provided with the first coupling member 182-2 that penetrates through the power connection part 108*c* from the insulation member 108*b* positioned on the upper surface of the power connection part 108*c*. The second coupling member 182-2 serves to fix the insulating member 108*b* and the heating element 108*a* to the power connection part 108*c*. The second coupling member 182-2 is in contact with the other end portion of the heating element 108*a* on the lower surface of the power connection part 108*c*.

The portion corresponding to the 1-2-th electrode pad 121-2 may be provided with a third coupling member 182-3 that penetrates through the power connection part 108*c*. The third coupling member 182-3 is in contact with the 1-2-th electrode pad 121-2 on the lower surface of the power connection part 108*c*.

On the other hand, an end surface (i.e., surface facing the control box) may be provided with a receiving groove 191. Further, the power interruption unit 123 may be received in the receiving groove 191 and fixed. The power interruption unit 123 may be electrically connected to the second coupling member 182-2 by a first connection part 193-1. The power interruption unit 123 may be electrically connected to a third coupling member 182-2 by a second connection part 193-1. That is, the power interruption unit 123 may be provided to electrically connect between the other end portion of the heating element and the 1-2-th electrode pad 121-2 by the first connection part 193-1 and the second connection part 193-2.

When the power interruption unit 123 is provided in the ice tray 102, the temperature (or temperature of the heating element 108*a*) of the ice tray 102 is directly sensed without a separate temperature sensor, and as a result the power applied to the heating element 108*a* may be interrupted when the sensed temperature exceeds the preset temperature. In this case, the reliability of the operation of the power interruption unit 123 may be increased. As the power interruption unit 123, the thermal fuse, the bimetal, or the like may be used. a thermal fuse or bimetal. The coupling members 182-1, 182-2, and 182-3, the heating element 108*a*, and the first electrode pads 121-1 and 121-2 may be connected by arc welding, electric welding, or the like.

Here, it is illustrated that the heating element 108*a* and the first electrode pads 121-1 and 121-2 are provided on the lower surface of the power connection part 108*c*, and the first connection part 193-1 and the second connection part 193-2 are connected to the second coupling member 182-2 and the third coupling member 182-3, respectively but the present invention is not limited thereto, and therefore the heating element 108*a* and the first electrode pads 121-1 and 121-2 may be provided on the upper surface of the power connection part 108*c* and the first connection part 193-1 and the second connection part 193-2 may be electrically connected to the other end portion of the heating element 108*a* and the 1-2-th electrode pads 121-2, respectively. At this point, the first connection part 193-1 and the second connection part 193-2 may be electrically connected to the other end portion of the heating element 108*a* and the 1-2-th electrode pad 121-2, respectively, by the arc welding, the electric welding, or the like. Further, it is described herein that one end portion of the heating element 108*a* is electrically connected to the 1-1 second electrode pad 121-1 by the first coupling member 182-1 but the present invention is not limited thereto, and therefore one end portion of the heating element 108*a* may be electrically connected to the 1-1-th electrode pad 121-1 by the arc welding, the electric welding, or the like without the separate coupling member.

Meanwhile, the first electrode pads 121-1 and 121-2 may be electrically connected to the main board in the control box by a lead wire (not illustrated). That is, the connector may not be provided in the control box. At this point, the power connection part 108*c* may be electrically connected to the main board in the control box by the lead wire (not illustrated).

Figure 29:
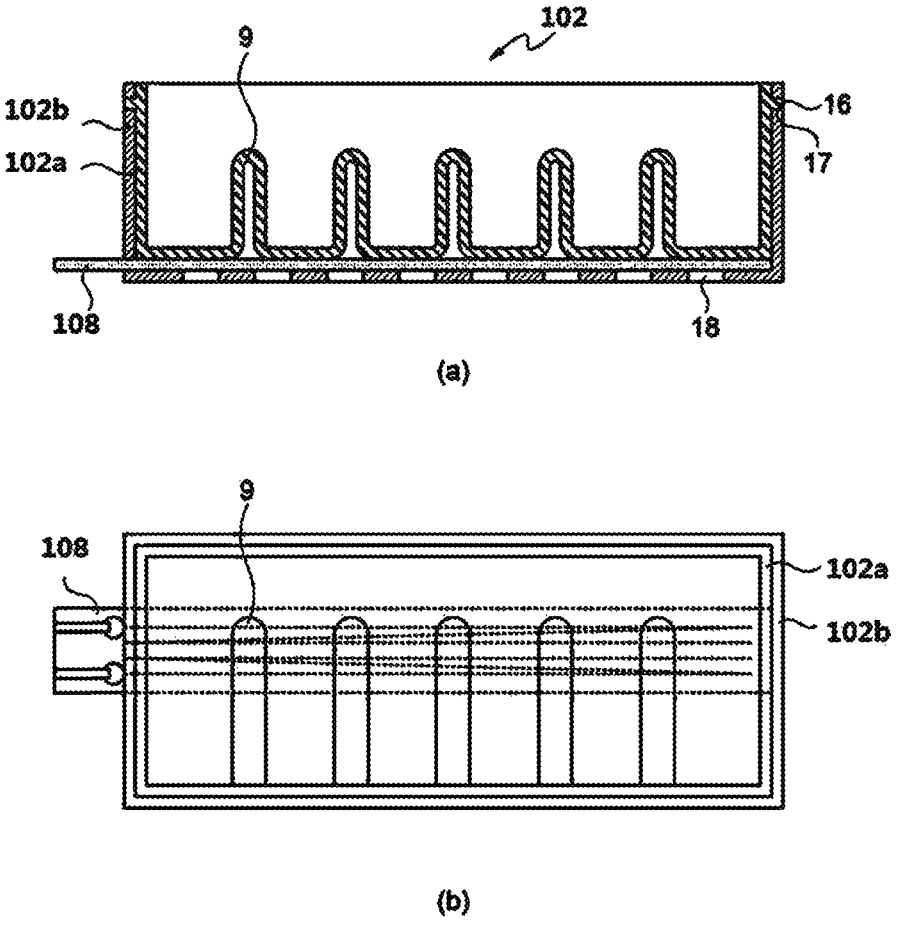
FIG. 29 is a view illustrating another embodiment of the ice tray in the ice maker according to the embodiment of the present invention.

FIG. 29 is a view illustrating another embodiment of the ice tray in the ice maker according to the embodiment of the present invention. FIG. 29 is a vertical cross-sectional view (FIG. 29A) and a plan view (FIG. 29) along a longitudinal direction schematically illustrating a configuration of an ice tray 102 according to an embodiment of the present invention.

Referring to FIG. 29, the ice tray 102 may include a first tray 102*a* formed of a metal thin plate and a second tray 102*b* formed of a resin. However, the present invention is not limited thereto, and the first tray 102*a* may be formed of the resin, and the second tray 102*b* may be formed of the metal thin plate. In addition, the first tray 102*a* and the second tray 102*b* may all be formed of resin or a metal thin plate. In addition, both of the first tray 102*a* and the second tray 102*b* may be formed of the resin or the metal thin plate.

The surface type heater 108 may be provided between the first tray 102*a* and the second tray 102*b*. The first tray 102*a* may be coupled to the second tray 102*b* to overlap inside the inside of the second tray 102*b*. Such a configuration may be, for example, implemented by insert injection of a resin into the first tray 102*a* formed of metal to form the second tray 102*b*.

The first tray 102*a* may be formed, for example, by pressing (drawing) the metal thin plate having a thickness of 0.5 mm or less or may be formed by aluminum die casting. A cross section of the first tray 102*a* may be a semicircle and both end portions thereof may be provided with a vertical wall. An inner space of the first tray 102*a* may be partitioned by a plurality of partitions 9. The partition wall 9 may be formed in a hollow shape. A hollow space of the partition wall 9 may communicate with the outside of the ice tray 102 through a cutout part 18 formed in the second tray 102*b* so that the cold air is more effectively transmitted to water received in the ice tray 102 through the first tray 102*a* to the ice tray 102, thereby shortening the freezing time.

Protrusions 16 are formed on an outer surface of the first tray 102*a*, for example, on an outer surface of the vertical wall and may be inserted into the corresponding grooves 17 of the second tray 102*b*. Alternatively, the grooves 17 and the protrusions 16 may be formed reversely, and the grooves 17 and the protrusions 16 may be formed in both the trays 102*a* and 102*b*. The shape of the protrusion may be various like a cylindrical shape, a square column shape, and a hook shape, and the shape of the corresponding groove may also be various. With the configuration, the coupling force between the first tray 102*a* and the second tray 102*b* is improved, and the second tray 102*b* is prevented from being separated from the first tray 102*a*. Alternatively or additionally, unevenness may be formed on the outer surface of the first tray 102*a*. The unevenness may increase the coupling force between the first tray 102*a* and the second tray 102*b* to more effectively prevent the second tray 102*b* from being separated from the first tray 102*a*.

The unevenness of the outer surface of the first tray 102*a* may be formed, for example, by embossing treatment or spraying treatment. The second tray 102*b* of the ice tray 102 may be coupled to the first tray 102*a* to surround the outer surface of the first tray 102*a*, that is, to allow the first tray 102*a* to overlap with the second tray 102*b*. The coupling may be formed, for example, by performing the insert injection of the second tray 102*b* into the first tray 102*a*. By the coupling, the structural rigidity of the ice tray 102 may be maintained by the second tray 102*a* even if the first tray 102*a* is formed of the thin metal plate. At this point, the injection molding may be performed in the state in which the surface type heater 108 to be disposed between the first tray 102*a* and the second tray 102*b* is preliminarily bonded to the outer surface of the first tray 102*a* by an adhesive sheet.

The grooves 17 corresponding to the protrusions 16 formed on the outer surface of the first tray 102*a* are naturally provided by performing the insert injection of the second tray 102*b* into the first tray 102*a*.

Further, the second tray 102*b* may be provided with a plurality of cutout parts 18 that expose the outer surface of the first tray 102*a*, for example, the outer surface of the bottom portion. The cutout parts 18 expose the outer surface of the first tray 102*a*, particularly, the bottom portion, and the shape and position thereof may be variously selected. However, the cutout part 18 may be disposed so that the portion of the ice tray 102 requiring more cool air, for example, the outer surface of the bottom portion adjacent to both end portions is exposed more. Further, some of the cutout parts 18 allow the outside of the ice tray 102 to communicate with the hollow space of the partition wall 9 to introduce cold air into the hollow of the partition wall. With the configuration, the cold air may be more effectively transmitted to the water received in the ice tray 102, thereby shortening the freezing time.

The surface type heater 108 disposed between the first tray 102*a* and the second tray 102*b* may be inserted by performing the insert injection of the second tray 102*b* into the outer surface of the first tray 102*a*. The surface type heater 108 may be disposed in a region other than the region where the cutout part 18 formed in the second tray 102*b* is disposed and thus may not be exposed through the cutout part 18.

Figure 30:
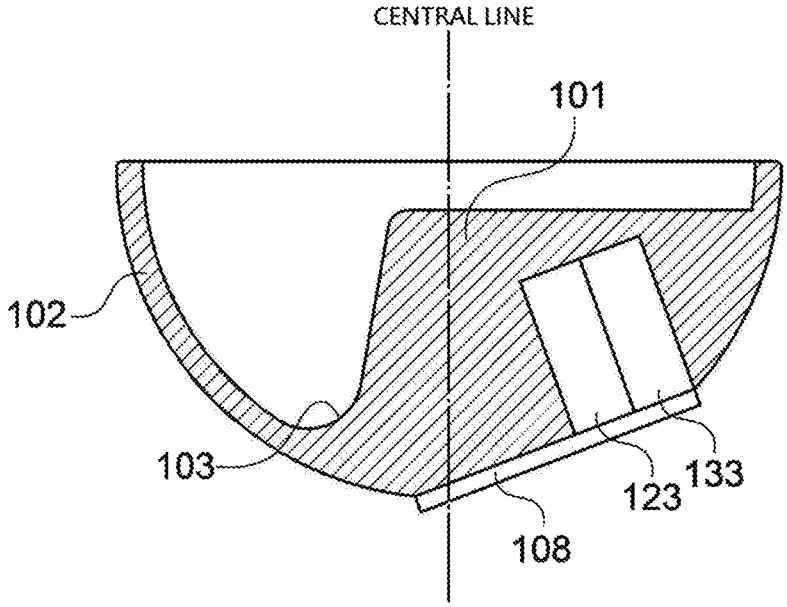
FIGS. 30 and 31 are views illustrating a state in which the surface type heater according to the embodiment of the present invention is mounted to be biased to one side from a center of the ice tray.
Figure 31:
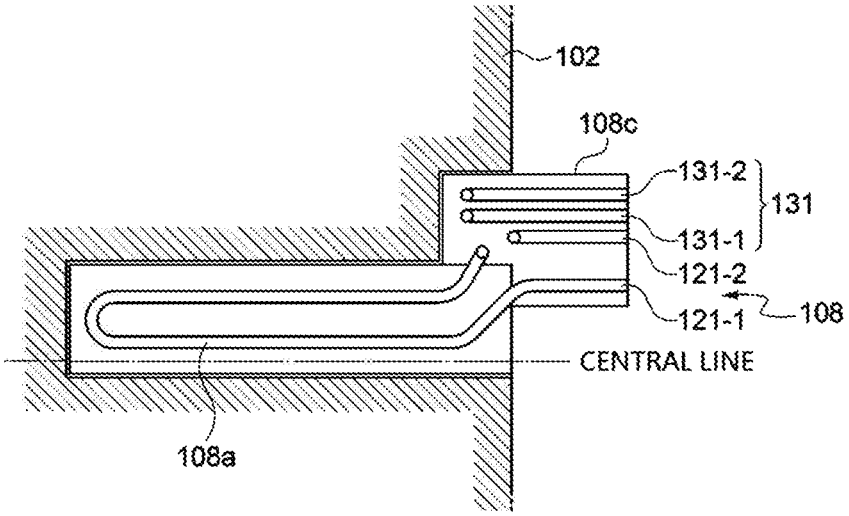

FIGS. 30 and 31 are views illustrating a state in which the surface type heater according to the embodiment of the present invention is mounted to be biased to one side from a center of the ice tray. FIG. 30 is a view illustrating a state in which the ice maker according to the embodiment of the present invention is viewed from the front. Here, for convenience of explanation, the portion of the ice tray 102 illustrates a cross-sectional view of the ice tray 102 in a width direction. FIG. 31 is a view illustrating a state in which the ice maker according to the embodiment of the present invention is viewed from the bottom.

Referring to FIG. 30, a plurality of partition walls 101 may be formed in the ice tray 102. Each of the partition walls 101 may be provided in the other direction from one side of the inner surface of the ice tray 102. That is, each of the partition walls 101 may be provided along the width direction of the ice tray 102. At this point, each of the partition walls 101 may be provided with ice-making water flow passages 103. When the ice-making water is supplied into the ice tray 102, each of the partition walls 101 may be provided with the ice-making water flow passages 103 to allow the supplied ice making water to be received in the entire longitudinal direction of the ice tray 102.

The surface type heater 108 may be provided on the bottom surface of the ice tray 102 to be biased to one side of the ice tray 102 with respect to the center of the ice tray 102. At this point, the surface type heater 108 may be provided to be biased to the side (i.e., side facing the side where the ice-making water flow path 103 is provided) where the partition 101 is provided. The surface type heater 108 is provided to be biased to the side where the partition 101 is provided, and thus the heat generated from the surface type heater 108 may be directly transmitted to the partition 101 to melt the ice that is coupled with the surface of the partition 101. The entire surface type heater 108 may be provided to be biased to one side with respect to the center of the ice tray 102 but the present invention is not limited thereto, and therefore the center of the surface type heater 108 may be provided to be biased to one side with respect to the center of the ice tray 102.

Further, the power interruption unit 123 and the temperature sensor 133 may be mounted on the end surface (i.e., surface facing the control box) of the ice tray 102. The power interruption unit 123 and the temperature sensor 133 each may be electrically connected to the surface type heater 108. The configuration in which the power interruption unit 123 and the temperature sensor 133 are electrically connected to the surface type heater 108 may be implemented in the same manner as illustrated in FIG. 28.

For example, each of the end surfaces of the ice tray 102 may be provided with receiving grooves that may receive and fix the power interruption unit 123 and the temperature sensor 133. Further, the power interruption unit 123 and the temperature sensor 133 are each connected to the surface type heater 108 via a connection part (for example, connection parts denoted by reference numerals 193-1, 193-2, or the like in FIG. 28) and a coupling member (for example, coupling members denoted by 182-1 to 182-3, or the like). Here, the power interruption unit 123 and the temperature sensor 133 are electrically connected to the power connection part 108*c* of the surface type heater 108.

The power interruption unit 123 and the temperature sensor 133 may be mounted on the end surface of the ice tray 102 to be adjacent to each other at the portion of the ice tray 102 biased to one side with respect to the center of the ice tray 102. The power interruption unit 123 and the temperature sensor 133 may be mounted to be further biased to one side than the surface heater 108 with respect to the center of the ice tray 102. In this manner, as the power interruption unit 123 and the temperature sensor 133 are mounted while being assembled at the portion biased to one side with respect to the center of the ice tray 102, the electrical connection structure of the power interruption unit 123 and the temperature sensor 133 may be simplified. This will be described in more detail with reference to FIG. 31.

Referring to FIG. 31, the surface type heater 108 may be provided to be biased to one side with respect to the center of the ice tray 106. Here, the power connection part 108*c* that is the end portion of the surface type heater 108 may be provided to be further biased to one side than the body of the surface type heater 108 with respect to the center of the ice tray 102.

The power connection part 108*c* may be provided with the 1-1-th electrode pad 121-1 and the 1-2-th electrode pad 121-2 electrically connected to one end portion and the other end portion of the heating element 108*a*, respectively. Here, the other end portion of the heating element 108*a* and the 1-2-th electrode pad 121-2 may be electrically connected to each other through the power interruption unit 123 as illustrated in FIG. 28. That is, the first connection part 193-1 of the power interruption unit 123 is electrically connected to the other end portion of the heating body 108*a* by the second coupling member 182-2 and the second connection part 193-2 of the power interruption unit 123 is electrically connected to the 1-2-th electrode pads 121-2 by the third coupling member 182-3, such that the other end portion of the heating element 108*a* and the 1-2-th electrode pad 121-2 may be electrically connected through the power interruption unit 123.

Further, the power connection part 108*c* may be provided with the second electrode pad 131 to which the temperature sensor 133 is electrically connected. The temperature sensor 133 may measure the temperature of the ice tray 102. The temperature sensor 133 may be electrically connected to the 2-1-th electrode pad 131-1 and the 2-2-th electrode pad 131-2 via the connection part 193 and the coupling member 182 illustrated in FIG. 28, or the like.

In this manner, the power connection part 108*c* is provided to be further biased to one side than the body of the surface type heater 108 with respect to the center of the ice tray 102, such that the power interruption unit 123 and the temperature sensor 133 may be mounted to be adjacent to each other by being concentrated on one place while being electrically connected to the power connection part 108*c*. Here, the entire power connection part 108*c* is illustrated as being further biased to one side than the body of the surface type heater 108 but the present invention is not limited thereto, and therefore the center of the power connection part 108*c* may be further biased to one side than the center of the surface type heater 108.

Meanwhile, DC power (for example, 12V, or the like) may be supplied to the surface type heater 108. Further, the DC power may be supplied to the ice-separating motor (not illustrated) that rotates the ejector 104. At this point, the surface type heater 108 and the ice-separating motor (not illustrated) may each be supplied with power through one power supply unit.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention should not be construed as being limited to the described embodiments but be defined by the appended claims as well as equivalents thereof.

DETAILED DESCRIPTION OF MAIN ELEMENTS

100: Ice maker
101: Partition wall
102: Ice tray
103: Ice-making water flow passage
104: Ejector

104-1: Ejector shaft
104-2: Ejector pin
106: Heater receiving part
106-1: First heater receiving part
106-2: Second heater receiving part
108: Surface type heater
108-1: First surface type heater
108-2: Second surface type heater
108*a*: Heating element
108*b*: Insulating member
108*c*: Power connection part
108*c*-1: Electrode pad
110: Control box
110*a*: Connector
112-1: First adhesive member
112-2: Second adhesive member
114: Heat insulating member
114-1: First heat insulating member
114-2: Second heat insulating member
116: Heater pressing part
118: Elastic member
121: First electrode pad
121-1: 1-1-th electrode pad
121-2: 1-2-th electrode pad
123: Power interruption unit
125: Insulating layer
127: Coupling member
129: Insertion hole
131: Second electrode pad
133: Temperature sensor
141: Guide part
142: Adhering member
143: Heater cover
143-1: Base plate
143-2: First side plate
143-3: Second side plate
143-4: Support plate
146: Packing member
146*a*: Insertion hole
147: Concave groove
148: Mounting guide part
148-1: First mounting guide part
148-2: Second mounting guide part
150: Mounting groove
152: Protrusion
154: PCB
156: Shrink tube
158: Adhesive
162: Water supply part
164-1: Surface type heater first part
164-2: Surface type heater second part
172-1: First insulating film
172-2: Second insulating film
174: Adhesive member
174-1: First adhesive member
174-2: Second adhesive member
176: Support plate
178: Partition
180: Through hole
182: Coupling member
184: Electrode pad guide part
186: Metal connection member

What is claimed is:

1. An ice maker, comprising:

an ice tray including a partitioned space in which ice-making water is received;

an ejector separating ice in the ice tray;

a sensor detecting at least one of a position of the ejector and a temperature of the ice tray;

a control box provided to face the ice tray and including a motor for driving the ejector and a printed circuit board disposed therein; and a surface type heater provided in the ice tray and including a heating element of a thin film or a heat wire and an insulating member surrounding the heating element, wherein the surface type heater is adhered to the ice tray by being pressed by an instrument provided in the ice tray.

2. The ice maker of claim 1, wherein the ice maker includes a heater pressing projection that is provided in the ice tray and presses the surface type heater to adhere the surface type heater to the ice tray, and the heater pressing projection has at least one of heat insulating property, insulating property, cushion property, heat conduction property, and elastic property.

3. The ice maker of claim 1, further comprising:

a receiving groove provided on an outer circumferential surface of the ice tray and having the surface type heater received therein.

4. The ice maker of claim 3, wherein a surface contacting one surface of the surface type heater of the receiving groove is provided to be inclined.

5. The ice maker of claim 3, wherein a surface contacting one surface of the surface type heater of the receiving groove is formed in a plane.

6. The ice maker of claim 1, wherein the instrument extends from a heater cover provided under the ice tray toward the ice tray to press the surface type heater.

7. The ice maker of claim 6, further comprising:

a cold air flow passage provided between the heater cover and the ice tray.

8. The ice maker of claim 1, further comprising:

a heater cover including a base plate provided under the ice tray, a first side plate extending from one side of the base plate toward one side of the outer circumferential surface of the ice tray, and a second side plate extending from the other side of the base plate toward the other side of the outer circumferential surface of the ice tray, wherein the instrument protrudes the base plate toward the ice tray to press the surface type heater.

9. The ice maker of claim 1, further comprising:

a receiving groove provided on an outer circumferential surface of the ice tray and having the surface type heater received therein, wherein the instrument presses the other surface of the surface type heater while being fitted in an inner side of the receiving groove.

10. The ice maker of claim 1, wherein the instrument includes at least one pressing protrusion that protrudes toward the surface type heater to press the other surface of the surface type heater.

11. The ice maker of claim 1, further comprising:

a heat resistance member or an elastic member provided between the surface type heater and the instrument.

12. The ice maker of claim 1, wherein the surface type heater is bonded to the ice tray by a polyimide adhesive, a silicon adhesive, or an adhesive paste including thermally conductive powder.

13. The ice maker of claim 1, wherein the surface type heater includes a power connection part electrically connected to the heating element, formed of a substrate, and having an electrode pad provided on one surface of the substrate, and the power connection part is formed of any one of a printed circuit board (PCB), a metal PCB, and plastic.

14. The ice maker of claim 1, wherein the surface type heater includes a power connection part electrically connected to the heating element, formed of a substrate, and having an electrode pad provided on one surface of the substrate, and the power connection part further includes:

a temperature sensor measuring a temperature of at least one of the ice tray and the surface type heater; and a second electrode pad electrically connected to the temperature sensor.

15. The ice maker of claim 1, wherein the surface type heater includes a support plate that is provided at a length corresponding to the surface type heater and is formed of any one of a PCB, a metal PCB, and plastic, and the heating element is provided by adhering the thin film or the heat wire to one surface of the support plate.

16. The ice maker of claim 1, wherein the surface type heater has a heating density changed depending on a position corresponding to the ice tray.

17. The ice maker of claim 1, wherein the surface type heater is provided on the outer circumferential surface of the ice tray to be biased to one side with respect to a center of the ice tray.

18. An ice maker, comprising:

an ice tray including a partitioned space in which ice-making water is received;

an ejector separating ice in the ice tray;

a sensor detecting at least one of a position of the ejector and a temperature of the ice tray;

a control box provided to face the ice tray and including a motor for driving the ejector and a printed circuit board disposed therein; and a surface type heater provided in the ice tray and including a heating element of a thin film or a heat wire and an insulating member surrounding the heating element, wherein the surface type heater is adhered to the ice tray by being pressed by an instrument provided in the ice tray and being bonded to the ice tray.

19. An ice maker, comprising:

an ice tray including a partitioned space in which ice-making water is received;

an ejector separating ice in the ice tray;

a sensor detecting at least one of a position of the ejector and a temperature of the ice tray;

a control box provided to face the ice tray and including a motor for driving the ejector and a printed circuit board disposed therein;

a surface type heater provided along a longitudinal direction of the ice tray from one side and the other side of an outer circumferential surface of the ice tray and including a surface type heater first part and a surface type heater second part including a heating element of a thin film or a heat wire and an insulating member surrounding the heating element;

a cold air contact section exposed from the circumferential surface of the ice tray to an outside between the surface type heater first part and the surface type heater second part; and a power connection part electrically connected to the heating elements of the surface type heater first part and the surface type heater second part, respectively, wherein one end of the surface type heater first part and one end of the surface type heater second part are connected to the power connection part and the other end of the surface type heater first part and the other end of the surface type heater second part are connected to or separated from each other, and the surface type heater is adhered to the ice tray by one or more of being pressed by an instrument provided in the ice tray and being bonded to the ice tray.

20. The ice maker of claim 19, wherein the power connection part is provided on one side or the other side of the outer circumferential surface of the ice tray, wherein the printed circuit board of the control box is disposed at a side corresponding to the power connection part so that the power connection part is inserted into the control box, and the surface type heater is adhered to the ice tray by one or more of being pressed by an instrument provided in the ice tray and being bonded to the ice tray.

* * * * *